US007216929B2

(12) United States Patent
Lang et al.

(10) Patent No.: US 7,216,929 B2
(45) Date of Patent: May 15, 2007

(54) SYSTEMS AND METHODS FOR A WHEELCHAIR TRAY

(75) Inventors: Mary Frances Lang, 585 Wildwood Dr., Greenville, MS (US) 38701; Gordon R. Tupper, Leland, MS (US)

(73) Assignee: Mary Frances Lang, Greenville, MS (US)

( * ) Notice: Subject to any disclaimer, the term of this patent is extended or adjusted under 35 U.S.C. 154(b) by 0 days.

(21) Appl. No.: 11/446,180

(22) Filed: Jun. 5, 2006

(65) Prior Publication Data

US 2006/0273633 A1 Dec. 7, 2006

Related U.S. Application Data

(63) Continuation-in-part of application No. 11/145,961, filed on Jun. 7, 2005.

(51) Int. Cl.
*A47B 83/02* (2006.01)

(52) U.S. Cl. ..... 297/155; 297/162

(58) Field of Classification Search ..... 297/145, 297/155, 162; 280/304.1, 250.1
See application file for complete search history.

(56) References Cited

U.S. PATENT DOCUMENTS

| | | | | |
|---|---|---|---|---|
| 2,937,694 | A | 5/1960 | Willson et al. | |
| 3,020,085 | A | 2/1962 | Russell | |
| 3,278,225 | A * | 10/1966 | Stine | 297/148 |
| 3,338,627 | A | 8/1967 | Frank | |
| 3,353,866 | A | 11/1967 | Chapman et al. | |
| 3,368,842 | A | 2/1968 | Polsky | |
| 3,515,429 | A | 6/1970 | Bollinger | |
| 3,547,488 | A | 12/1970 | Barnes | |
| 3,567,277 | A | 3/1971 | Ryn | |
| 3,575,466 | A * | 4/1971 | Thomas et al. | 297/155 |
| 3,606,450 | A * | 9/1971 | Sedgwick | 297/149 |
| 3,784,249 | A | 1/1974 | Hendrickson et al. | |
| 3,857,605 | A | 12/1974 | Fantoni | |
| 3,870,362 | A | 3/1975 | Large | |
| 3,999,798 | A | 12/1976 | Roulier | |
| 4,081,198 | A | 3/1978 | Penney | |
| 4,203,624 | A | 5/1980 | Hopkins | |
| 4,223,944 | A | 9/1980 | DeLong | |
| 4,288,122 | A | 9/1981 | Meek | |
| 4,364,699 | A | 12/1982 | Koppes | |
| 4,428,616 | A | 1/1984 | Hamilton | |
| 4,436,339 | A | 3/1984 | Albers | |
| 4,566,732 | A * | 1/1986 | Ostergaard et al. | 297/155 |
| 4,580,803 | A | 4/1986 | Davis | |
| 4,632,451 | A | 12/1986 | Lee | |
| 4,659,099 | A | 4/1987 | Malone | |
| 4,662,676 | A | 5/1987 | Havelock | |
| 4,685,726 | A | 8/1987 | Wolpert, Jr. | |
| 4,705,287 | A | 11/1987 | Cumbie | |
| 4,779,884 | A | 10/1988 | Minati | |

(Continued)

FOREIGN PATENT DOCUMENTS

| | | |
|---|---|---|
| GB | 1 526 781 | 9/1978 |
| JP | A 10-179656 | 7/1998 |

*Primary Examiner*—Peter R. Brown
(74) *Attorney, Agent, or Firm*—Oliff & Berridge, PLC

(57) ABSTRACT

Systems and methods for a wheelchair tray may include providing a tray portion and a connecting portion attached thereto. The connecting portion may be configured to attach to a wheelchair. The connecting portion may provide the tray portion with a first rotation in a plane substantially parallel to a plane of rotation of a non-pivoting wheel of the wheelchair and a second rotation in a plane substantially perpendicular to the plane of rotation of the non-pivoting wheel. The connecting portion may be releasably fixable against the first rotation.

20 Claims, 19 Drawing Sheets

U.S. PATENT DOCUMENTS

| | | | |
|---|---|---|---|
| 4,834,449 | A | 5/1989 | Engelman |
| 4,848,833 | A | 7/1989 | Grall |
| 4,878,685 | A | 11/1989 | Bahm |
| 5,026,114 | A | 6/1991 | Miller |
| 5,139,309 | A | 8/1992 | Kornreich |
| 5,207,477 | A | 5/1993 | Maxwell |
| 5,228,711 | A | 7/1993 | Summers |
| 5,299,824 | A | 4/1994 | Roberts et al. |
| 5,333,929 | A | 8/1994 | Slagerman |
| 5,490,710 | A | 2/1996 | Dearing et al. |
| 5,588,663 | A | 12/1996 | Rundle et al. |
| 5,765,911 | A | 6/1998 | Sorenson |
| 5,799,964 | A | 9/1998 | Chao |
| 5,842,745 | A | 12/1998 | Kelly et al. |
| 6,073,997 | A | 6/2000 | Koh |
| 6,220,658 | B1 | 4/2001 | Lukawski et al. |
| 6,224,149 | B1 | 5/2001 | Gevaert |
| 6,354,658 | B1 | 3/2002 | Sher et al. |
| 6,450,570 | B1 | 9/2002 | Hoekstra et al. |

* cited by examiner

320

350
340
320

320

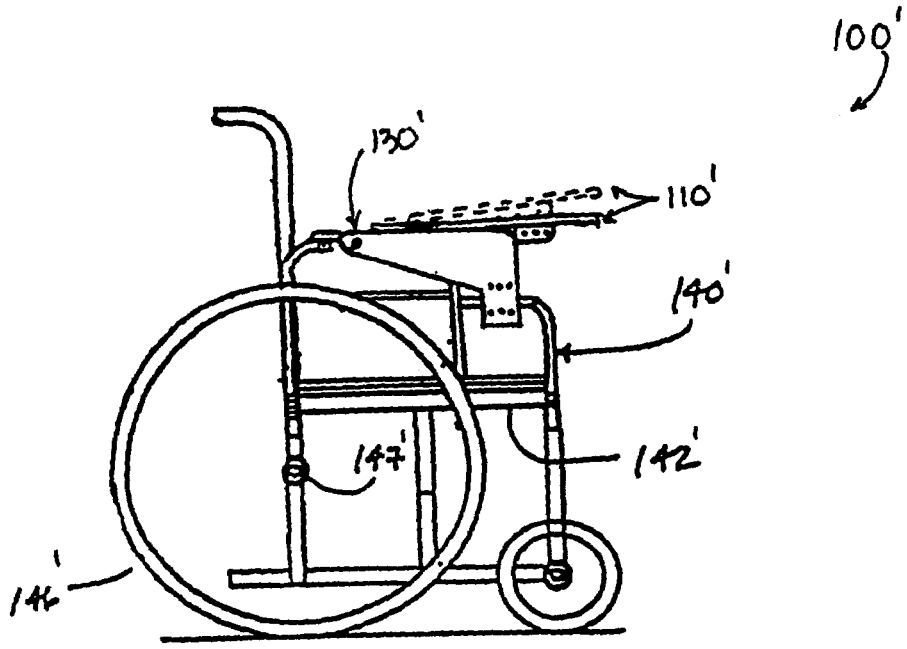
FIG. 28
Fig. 29
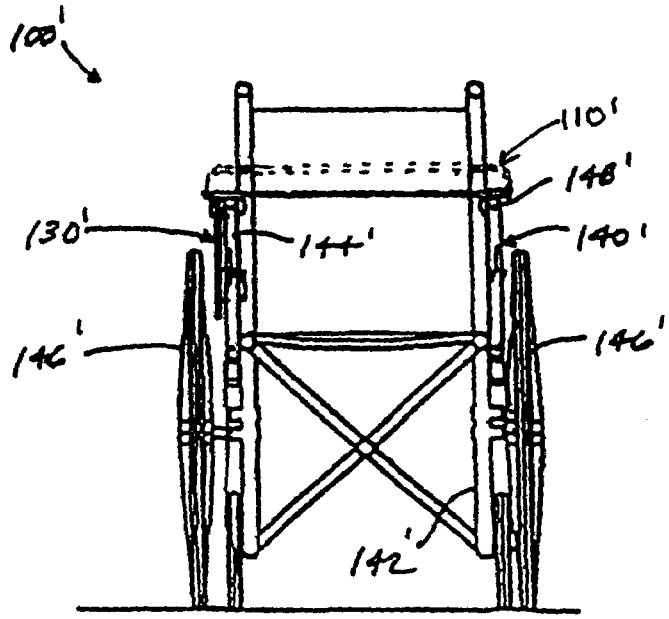

SYSTEMS AND METHODS FOR A WHEELCHAIR TRAY

CROSS-REFERENCE TO RELATED APPLICATION

This application is a Continuation-in-Part application and claims the benefit of U.S. patent application Ser. No. 11/145,961, filed on Jun. 7, 2005, the entire disclosure of which is incorporated herein by reference.

BACKGROUND

This invention relates generally to trays adapted for use with a wheelchair and methods for using such trays.

Various wheelchair designs are known, each having its own advantages and disadvantages. Further, various tray designs for wheelchairs are known, some that form an integral part of a wheelchair and some that comprise an attachment for a wheelchair. For example, U.S. Pat. Nos. 5,139,309, 5,207,477, 5,490,710, 5,765,911, 5,842,745, 6,073,997, 6,220,658 and 6,224,149 describe various tray devices, most of which are designed for wheelchair use.

Each of the foregoing patents is incorporated herein by reference in its entirety.

SUMMARY

Despite the development in this area as represented by the foregoing patents, few, if any, wheelchair designs that include a tray are currently available on the market. Similarly, few, if any tray attachments specifically designed for wheelchair use are currently available on the market.

Various exemplary embodiments of a wheelchair tray apparatus may provide a convenient accessory and/or feature for a wheelchair whereby a user may easily operate a tray portion from a stored position to a use position in which the tray portion is useful to hold various items and/or as a work surface. The tray apparatus portion may be a separate attachment for a wheel chair or may be an integral part of the wheelchair itself.

Various exemplary embodiments of a wheelchair tray apparatus may include a tray portion that provides at least one substantially planar working surface. The working surface may be discontinuous, for example, including indentations, projections and/or holes, such as for accommodating various items in a secure and/or convenient fashion. The working surface may be smooth, textured, coated or otherwise treated to achieve a desired effect, for example, providing friction, cushioning and/or absorbency. For example, the working surface may include an absorbent liner, such as a napkin material.

Various exemplary embodiments of a wheelchair tray apparatus may include a connecting portion attached to the tray portion. The connecting portion may be configured to attach to a frame member of a wheelchair, for example, such as an arm support member. The connecting portion may provide a first rotation of the tray portion in a plane substantially parallel to a plane of rotation of a non-pivoting wheel of a wheelchair when the connecting portion is attached to the wheelchair. The connecting portion may also provide a second rotation of the tray portion in a plane substantially perpendicular to the plane of rotation of the non-pivoting wheel of the wheelchair when the connecting portion is attached to the wheelchair.

In various exemplary embodiments, the first rotation of the tray portion may be between a first storage position in which at least most of the tray portion is disposed rearward of an axle of the non-pivoting wheel, a second storage position in which at least most of the tray portion is disposed forward of the axle of the non-pivoting wheel, and a position between the first and second storage positions in which the second rotation of the tray portion is permitted.

In various exemplary embodiments, a wheelchair tray apparatus may also include a securing mechanism mounted on a part of the tray portion, other than the working surface. In such embodiments, the securing mechanism may be configured to connect to at least one arm support member of a wheelchair when the connecting portion is attached to the wheelchair and the tray portion is in a use position. Alternatively or additionally, the securing mechanism may be configured to connect to a part of a wheelchair when the connecting portion is attached to the wheelchair and the tray portion is in at least one of the first and second storage positions.

In various exemplary embodiments, a wheelchair tray apparatus may include a wheelchair having a frame with at least one frame member disposed adjacent to a non-pivoting wheel rotatably mounted on an axle. In such embodiments, the connecting portion may be attached to the frame member with the plane of the first rotation located between the non-pivoting wheel and the frame.

In various exemplary embodiments, a wheelchair tray apparatus may include an arm support member configured to attach to a frame of a wheelchair. In such embodiments, the connecting portion may be attached to the arm support member.

Various exemplary embodiments of a method of using a wheelchair tray apparatus may provide a convenient method of using an accessory and/or a feature of a wheelchair whereby a user may easily operate a tray portion from a stored position to a use position. In various exemplary embodiments, a method of using a wheelchair tray apparatus may include attaching a connecting portion to a frame member of a wheelchair, providing a first rotation of the tray portion in a plane substantially parallel to a plane of rotation of a non-pivoting wheel of the wheelchair via the connecting portion, providing a second rotation of the tray portion in a plane substantially perpendicular to the plane of rotation of the non-pivoting wheel of the wheelchair, and selectively rotating the tray portion via the first rotation into at least one of a first storage position in which at least most of the tray portion is disposed rearward of an axle of the non-pivoting wheel and a second storage position in which at least most of the tray portion is disposed forward of the axle of the non-pivoting wheel.

In various exemplary embodiments, the method may also include rotating the tray portion via the second rotation into a use position. In various exemplary embodiments, the method may also include securing the tray portion to another frame member of the wheelchair when the tray portion is in at least one of the first storage position, the second storage position and the use position.

Various exemplary embodiments of a wheelchair tray apparatus may include a tray portion providing at least one substantially planar working surface and a connecting portion attached to the tray portion. The connecting portion may be configured to attach to a first portion of a frame of a wheelchair. The connecting portion may provide a first rotation of the tray portion in a plane substantially parallel to a plane of rotation of a non-pivoting wheel of the wheelchair when the connecting portion is attached to the wheelchair. The connecting portion may provide a second rotation of the tray portion in a plane substantially perpendicular to the plane of rotation of the non-pivoting wheel of the wheelchair when the connecting portion is attached to the wheelchair. The connecting portion may be releasably fixable against the first rotation.

In various exemplary embodiments, the connecting portion may be releasably fixable such that the at least one substantially planar working surface is disposed at a non-zero angle relative to a plane including a seat of the wheelchair when the connecting portion is attached to the wheelchair and the tray portion is in a use position.

In various exemplary embodiments, a wheelchair tray apparatus may include a support member that is configured to attach to a second portion of a frame of a wheelchair. The support member may be rotatable in a plane substantially parallel to the plane of rotation of the non-pivoting wheel of the wheelchair when the support portion is attached to the wheelchair. The support member may be releasably fixable against rotation.

In various exemplary embodiments, the connecting portion may be releasably fixable such that the at least one substantially planar working surface is disposed at a non-zero angle relative to a plane including a seat of the wheelchair when the connecting portion is attached to the wheelchair and the tray portion is in a use position, and the support member may be releasably fixable to support the tray portion at the non-zero angle.

In various exemplary embodiments, a wheelchair tray apparatus may also include a stop that limits rotation of the support member to a predetermined position. The support member in the predetermined position may support the tray portion such that the at least one substantially planar working surface is disposed substantially parallel to a plane including a seat of the wheelchair when the connecting portion and the support portion are attached to the wheelchair and the tray portion is in a use position.

In various exemplary embodiments, a wheelchair tray apparatus may include a securing mechanism mounted on a part of the tray portion other than the working surface. The securing mechanism may be configured to cooperate with the support member when the connecting portion and the support portion are attached to the wheelchair and the tray portion is in a use position. The securing mechanism may be magnetic or non-magnetic. The securing mechanism may be configured to cooperate with a part of a wheelchair when the connecting portion is attached to the wheelchair and the tray portion is in a storage position.

In various exemplary embodiments, a wheelchair tray apparatus may include a wheelchair including a frame comprising at least one frame member disposed adjacent to a non-pivoting wheel rotatably mounted on an axle. The connecting portion may be attached to the frame member. The plane of the first rotation may be located between the non-pivoting wheel and the frame. The first rotation of the tray portion may include a storage position of the tray portion between the non-pivoting wheel and the frame. The tray portion in the storage position may be substantially rearward of the axle of the non-pivoting wheel.

Various exemplary embodiments of a method of using a wheelchair tray apparatus, the apparatus including a tray portion that provides at least one substantially planar working surface and a connecting portion attached to the tray portion, may include attaching the connecting portion to a first portion of a frame of a wheelchair, providing a first rotation of the tray portion in a plane substantially parallel to a plane of rotation of a non-pivoting wheel of the wheelchair via the connecting portion, providing a second rotation of the tray portion in a plane substantially perpendicular to the plane of rotation of the non-pivoting wheel of the wheelchair, and selectively rotating the tray portion via the first rotation and the second rotation. Selectively rotating the tray portion may include rotating the tray portion via the first rotation into a storage position in which the tray portion is substantially rearward of an axle of the non-pivoting wheel. Selectively rotating the tray portion may include rotating the tray portion via the first rotation into a first position and rotating the tray portion via the second rotation into a use position while the tray portion is in the first position.

In various exemplary embodiments, the method may also include supporting the tray portion in the use position while the tray portion is in the first position using a support portion other than the connecting portion. Rotating the tray portion via the first rotation into the first position may be such that the at least one substantially planar working surface is disposed at a non-zero angle relative to a plane including a seat of the wheelchair.

In various exemplary embodiments, the method may also include releasably fixing the tray portion in the first position.

These and other features are described in or are apparent from the following detailed description.

BRIEF DESCRIPTION OF THE DRAWINGS

Various details are described below, with reference to the following figures, wherein:

FIG. 28 is a side view corresponding to FIG. 27, illustrating the tray portion tilted relative to the wheelchair;

FIG. 29 is a front view corresponding to FIG. 27, illustrating the tray portion tilted relative to the wheelchair;

DETAILED DESCRIPTION

The following detailed description provides various details with respect to a wheelchair tray apparatus including a wheelchair. Further, various details are provided with respect to a wheelchair tray apparatus including a frame member of a wheelchair. However, it will be understood that various aspects of the invention may be applied to a wheelchair tray apparatus without including the wheelchair or a frame member of the wheelchair, as desired. Thus, the following description is intended to be illustrative and not limiting.

In the exemplary implementations described herein, a particular wheelchair design is shown. However, it should be understood that the design is illustrative only, and that various wheelchair designs may embody or utilize the various features described herein.

Figure 1:
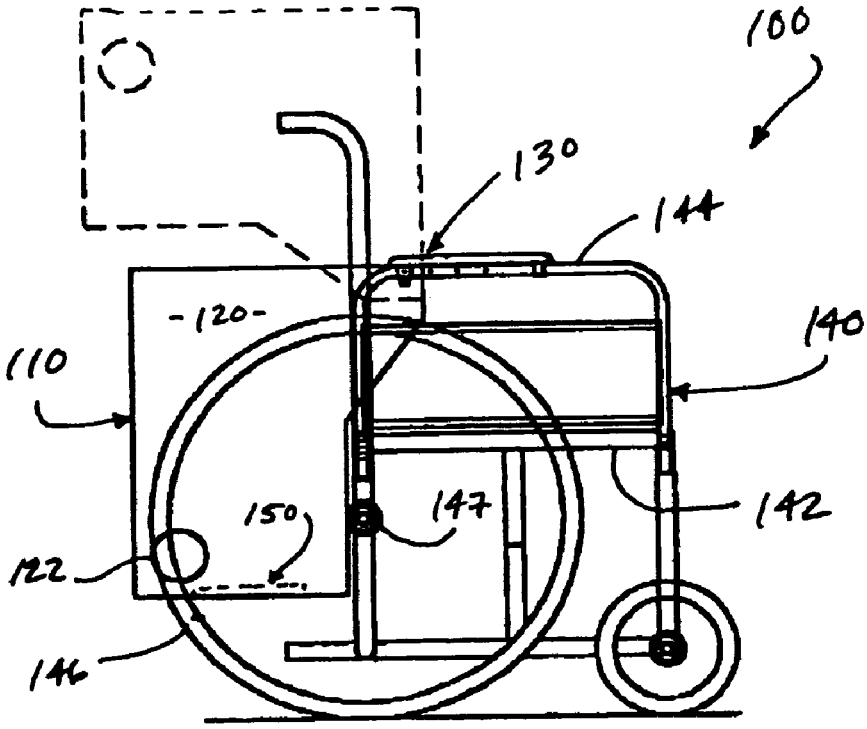
FIG. 1 is a side view of an exemplary wheelchair tray apparatus, shown with the tray portion in a first storage position.

FIG. 1 illustrates an exemplary wheelchair tray apparatus 100. As shown in this side view, the wheelchair apparatus 100 may include a tray portion 110 having a substantially planar working surface 120. While it is possible that a surface opposite the working surface 120 may provide a second working surface, such a design is not shown in FIG. 1.

The tray portion 110 and the working surface 120 may have any desired configuration. For example, the size and shape of the tray portion 110 may be designed for a particular use or for a person with a particular disability. A general multi-purpose design is shown having a recess or cutout 122 in the working surface 120. The recess or cutout 122 is not limited to a single instance or a circular configuration as shown. On the contrary, various recesses and/or cutouts may be provided that are designed for particular items and/or functions as desired. For example, the recess or cutout 122 may comprise a stepped configuration designed to cooperate with an attachment to allow the attachment to be rotated within the recess or cutout 122 in one position and "locked" against rotation in another position. Such a stepped configuration may comprise a square-to-round hole designed to receive a complementary stem of an attachment.

In this design, the recess or cutout 122 may provide a receptacle for receiving and holding various items that a person may use and wish to have easy access to. The recess or cutout 122 may itself form a container for items or may be designed to receive a container. For example, a beverage or other container (not shown) may fit within the recess or cutout 122.

Alternatively or additionally, the recess or cutout 122 may be designed to receive an attachment. For example, if a user wishes to employ a different surface rather than the working surface 120 of the tray portion 110, a work table (not shown) may be provided that includes a portion designed to fit in the recess or cutout 122. Such a work table may substantially correspond to the design of the tray portion 110, for example, and may rest on the working surface 120 at one or more points to provide stability. Alternatively or additionally, such a work table may be designed as an extension of the tray portion 110.

The work table may fit in the recess or cutout 122 of the tray portion 110 with a complementary recess or cutout, for example. Further, the work table may include a recessed lip designed to engage an edge of the tray portion 110. In conjunction with the insertion of a portion of the work table in the recess or cutout 122, engagement of an edge of the tray portion 110 with the recessed lip of the work table may secure the work table to the tray portion and add stability to the work table, whether the work table is designed to cover the working surface 120 and/or to extend from the tray portion 110.

The working surface 120 and or a corresponding surface of the work table may be smooth, textured, coated or otherwise treated to achieve a desired effect, for example, providing friction, cushioning and/or absorbency.

The wheelchair tray apparatus 100 may further include a connecting portion 130. The connecting portion 130 may be of any known or hereafter developed configuration or design that is suitable for providing the rotational movements of the tray portion 110, as described herein, when the tray portion 110 is attached via the connecting portion 130.

The wheelchair tray apparatus 100 may further include a wheelchair 140. As described above, the wheelchair tray apparatus 100 may or may not include the wheelchair 140. For example, the wheelchair tray apparatus 100 may comprise the tray portion 110 and the connecting portion 130, with the connecting portion 130 designed to attach to a wheelchair of a particular or various design.

Figure 2:
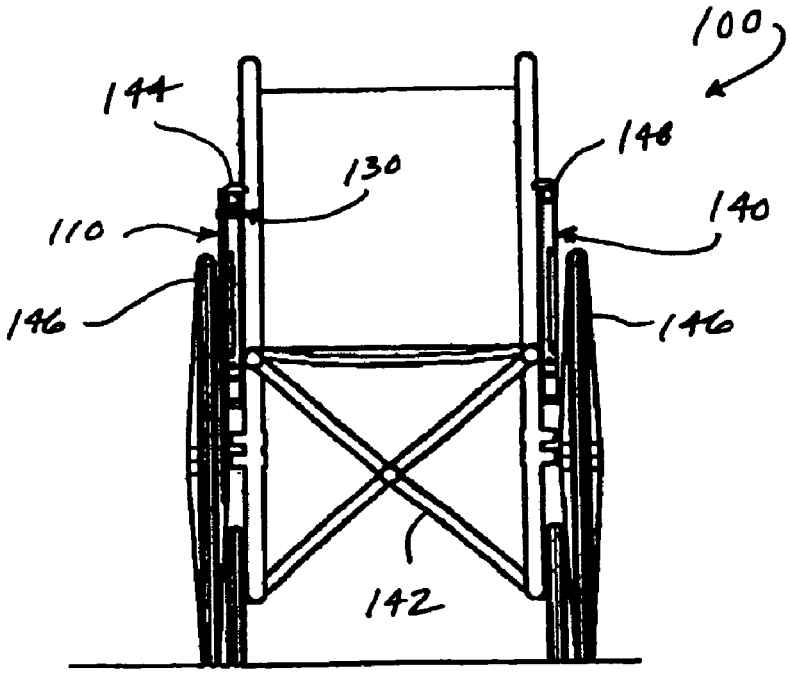
FIG. 2 is a front view corresponding to FIG. 1.

As shown in FIG. 1, the wheelchair 140 may have a frame 142 or other support structure, for example, including at least one frame member, such as an arm support member 144. The wheelchair 140 may also have a non-pivoting wheel 146 on each side. As illustrated in FIG. 2, for example, the frame 142 may be collapsible to allow the wheelchair 140 to be compacted for transportation and/or storage when not in use. The wheelchair tray apparatus 100 may allow for such a design of the frame 142 without substantially interfering with collapsing of the frame 142 or substantially impairing compactness. Other details of the wheelchair 140 are not provided since they are a matter of preference and design not critical to the disclosure.

The tray portion 110 may be attached, either permanently or detachably, to the wheelchair 140 via the connecting portion 130. For example, the connecting portion 130 may attach to the frame 142. In particular, connecting portion 130 may attach to the arm support member 144, as shown in FIG. 1.

When the connecting portion 130 is attached to the wheelchair 140, the tray portion 110 may be moved between a use position and one or more desired storage positions. For example, the connecting portion 130 may provide a first rotation of the tray portion 110 in a plane substantially parallel to a plane of rotation of one of the non-pivoting wheels 146 of the wheelchair 140. As shown in FIG. 1, the tray portion 110 may be conveniently placed in a first storage position toward a rear of the wheelchair 140. The first storage position may be achieved with the aid of gravity, for example, having the tray portion 110 come to rest against adjacent to an axle of the non-pivoting wheel 146, for example against a resilient cushion or bumper 147.

In the first storage position, the tray portion 110 may be disposed at least partly between the non-pivoting wheel 146 and the frame 142, as shown in FIGS. 1 and 2. The first storage position may place the entire tray portion 110 slightly below an upper surface of the arm support member 144, for example, to avoid contact with the user of the wheelchair 140 when the tray portion 110 is not in use. Further, the first storage position may allow the user of the wheelchair 140 unfettered access to the non-pivoting wheel 146, for example, to allow the user to manually rotate the non-pivoting wheel 146 and/or operate a brake (not shown) to lock the non-pivoting wheel 146 against unwanted rotation.

Figure 3:
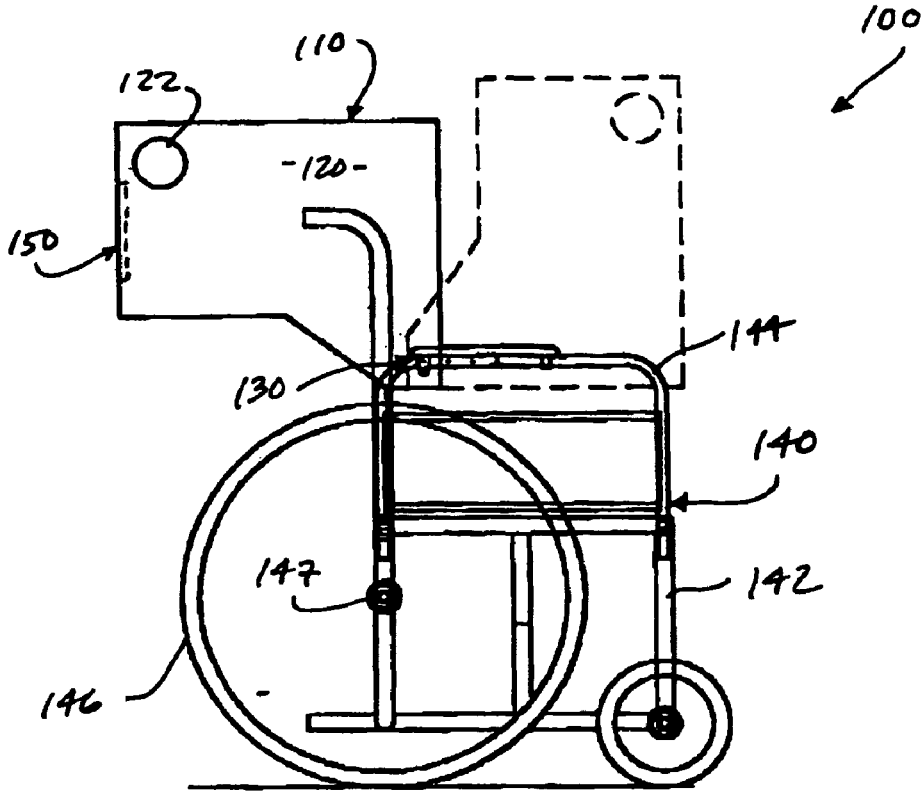
FIG. 3 is a side view of the exemplary wheelchair tray apparatus of FIG. 1, shown with the tray portion rotated from the first storage position.
Figure 4:
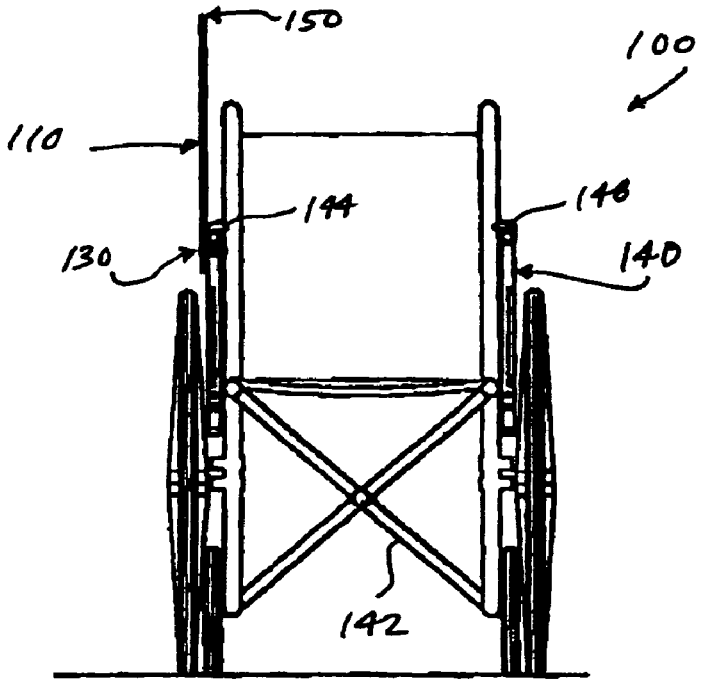
FIG. 4 is a front view corresponding to FIG. 3.

As illustrated in dashed-lines in FIG. 1, the first rotation in the plane substantially parallel to the plane of rotation of the non-pivoting wheel 146 provided by the connecting portion 130 may allow the tray portion 110 to be rotated from the first storage position upward and toward a front of the wheelchair 140, e.g., clockwise in FIG. 1, and into a position as shown in FIGS. 3 and 4. As illustrated in dashed-lines in FIG. 3, the tray portion 110 may be further rotated into an intermediate position, as shown in FIGS. 5–7.

Figure 5:
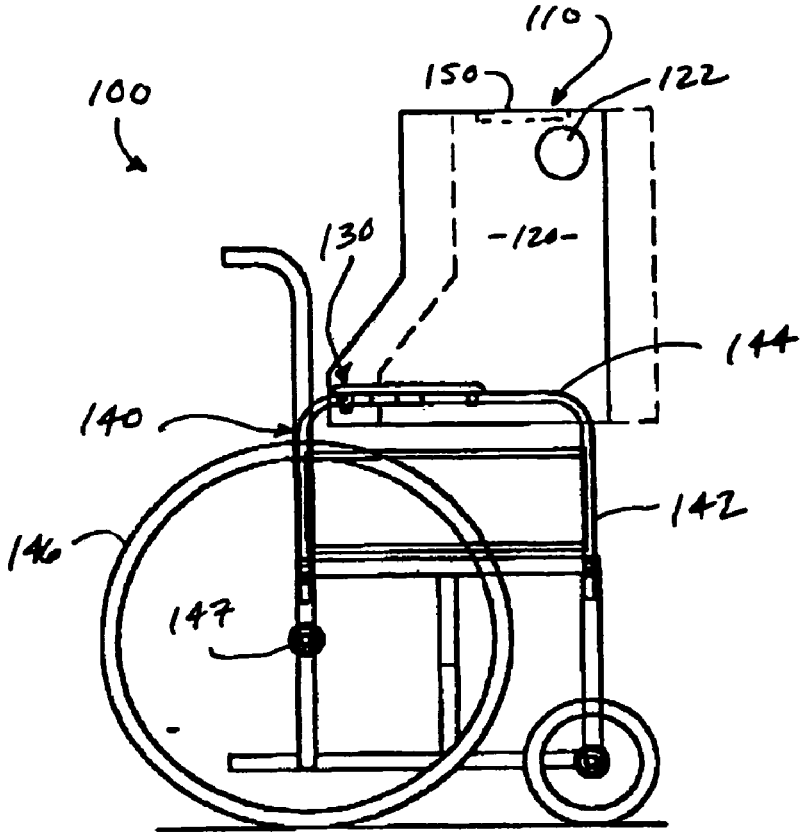
FIG. 5 is a side view of the exemplary wheelchair tray apparatus of FIG. 1, shown with the tray portion rotated into an intermediate position.
Figure 6:
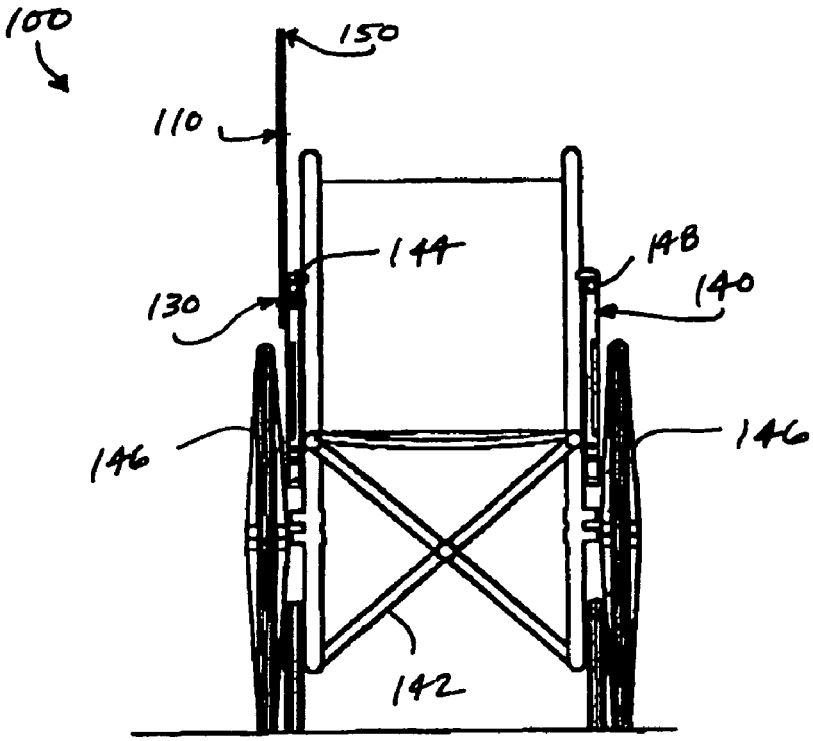
FIG. 6 is a front view corresponding to FIG. 5.
Figure 7:
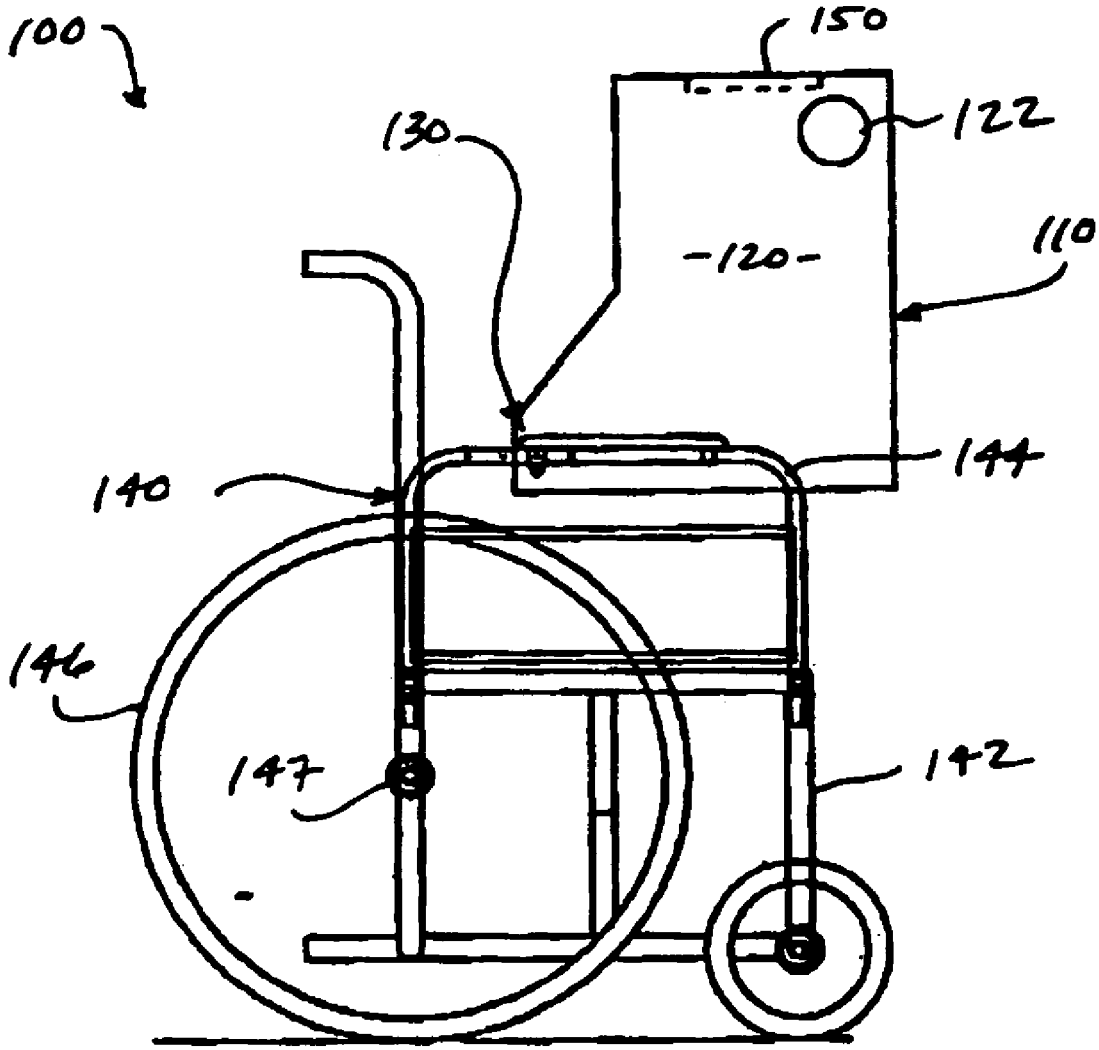
FIG. 7 is a side view of the exemplary wheelchair tray apparatus of FIG. 1, shown with the tray portion translated forward relative to the wheelchair.

In addition to showing the tray portion 110 in the intermediate position, FIGS. 5–7 illustrate an optional movement of the tray portion 110 that may be provided by the connecting portion 130. As illustrated in dashed-lines in FIG. 5, the tray portion 110 may be translated in a forward-rearward direction relative to the wheelchair 140. The connecting portion 130 may allow the tray portion 110 to be translated whether or not the tray portion 110 has been rotated in the plane substantially parallel to the plane of rotation of the non-pivoting wheel 146, and whether or not the tray portion 110 is in that plane of rotation. The translation of the tray portion 110 may place the tray portion 110 in the intermediate position shown in FIG. 7.

The connecting portion 130 may also provide a second rotation of the tray portion 110 in a plane substantially perpendicular to the plane of rotation of the non-pivoting wheel 146 of the wheelchair 140. As illustrated in dashed-lines in FIG. 8, the second rotation in the plane substantially perpendicular to the plane of rotation of the non-pivoting wheel 146 provided by the connecting portion 130 may allow the tray portion 110 to be rotated from the intermediate position downward toward a lap of the user of the wheelchair 140, e.g., into the page in FIG. 8, and into a use position in front of the user, as shown in FIGS. 8 and 9.

Figure 9:
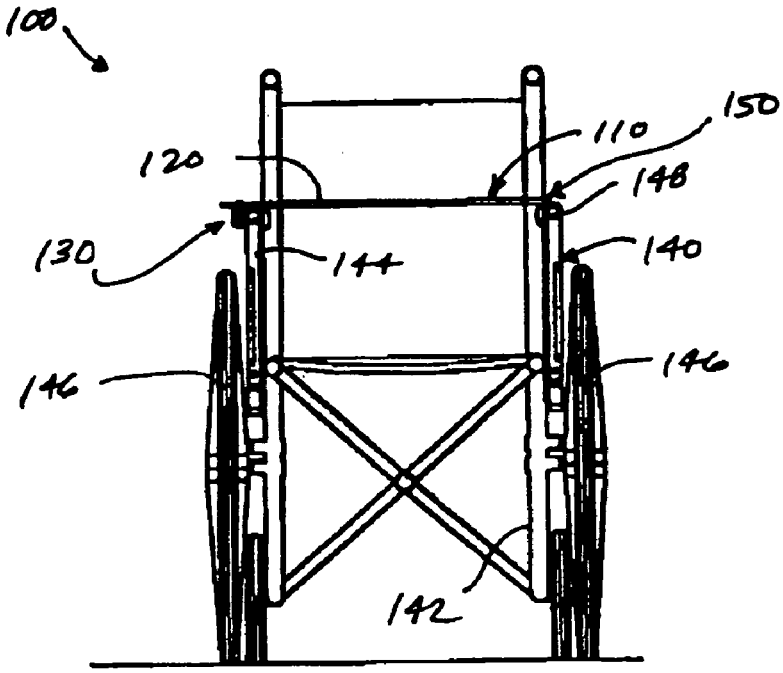
FIG. 9 is a front view corresponding to FIG. 8.

As shown in FIG. 9, in the use position, the tray portion 110 may rest on the upper surface of the arm support member 144 and may extend toward a second arm support member 148 on an opposite side of the wheelchair 140. Further, in the use position, the tray portion 110 may span the arm support members 144, 148, resting on the upper surface of each.

The tray portion 110 may be held in the use position by gravity. Alternatively or additionally, the tray portion 110 may be secured in the use position by any known or hereafter developed mechanism. For example, one of the tray portion 110 and either arm support member 144, 148 may include a magnet strip and the other may include another magnetic material such that the strip and material are sufficiently attracted to each other to properly secure the tray portion 110 against that arm support member 144, 148 in the use position.

Figure 8:
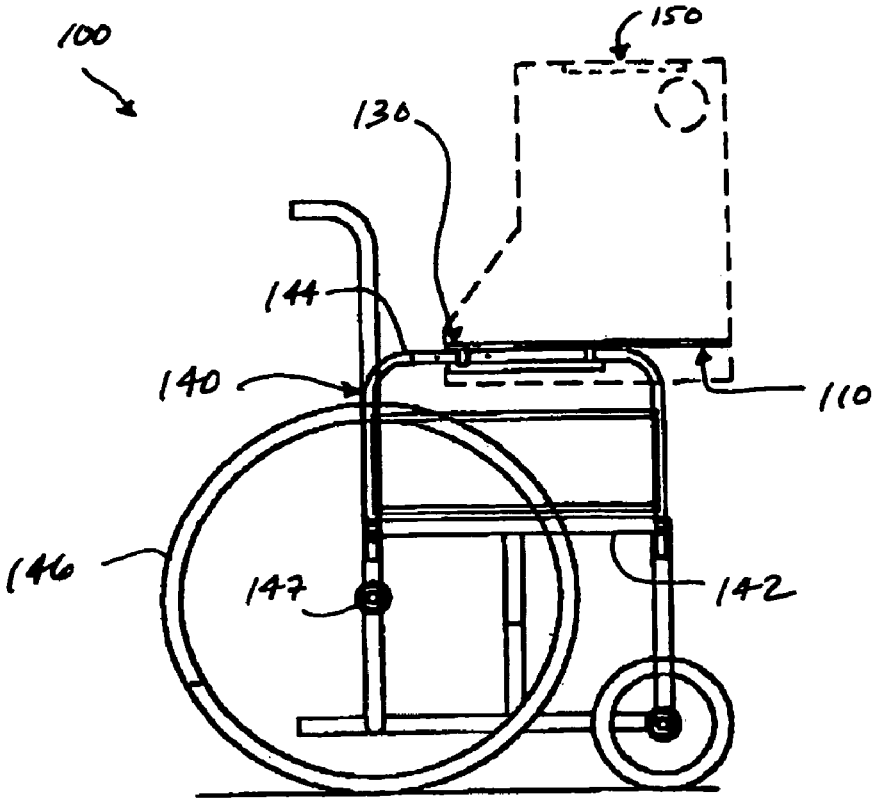
FIG. 8 is a side view of the exemplary wheelchair tray apparatus of FIG. 1, shown with the tray portion rotated into a use position.

For example, part of the second arm support member 148 may be made of a magnetically attractable material such as a metal, and the tray portion 110 may include a magnetic strip 150 as shown in FIG. 8. The magnet strip 150 may be attached to the tray portion 110, for example, on a surface opposite the working surface 120, or embedded in the tray portion 110. When the tray portion 110 is rotated in the second rotation toward the use position, e.g., toward the second arm support member 148, the distance between the magnet strip 150 and the magnetically attractable part of the second arm support member 148 decreases to a point at which the magnetic field of the magnetic strip 150 sufficiently attracts the magnetically attractable part of the second arm support member 148.

Alternatively or additionally, the magnetic strip 150 may be located on the tray portion 110 near a part that contacts the arm support portion 144 when the tray portion 110 is in the use position. Further, the magnetic strip 150 may be attached or embedded in one or both of the arm support portions 144, 148 and a part of the tray portion 110 may be made of a magnetically attractable material. For example, a surface of the tray portion opposite the working surface 120 may be made of a magnetic metal or the tray portion 110 may be made of a magnetic metal.

Other mechanisms may be used for securing the tray portion 110 in the use position as well. For example, any appropriate spring lock, either known or hereafter developed, may be used.

As will be understood from FIGS. 5–9, the optional translation of the tray portion 110 may provide additional or necessary clearance for a user when rotating the tray portion 110 in the second rotation to the use position. Further, the optional translation may allow a user to adjust a distance between the user and the tray portion 110 when the tray portion 110 is in the use position.

Figure 10:
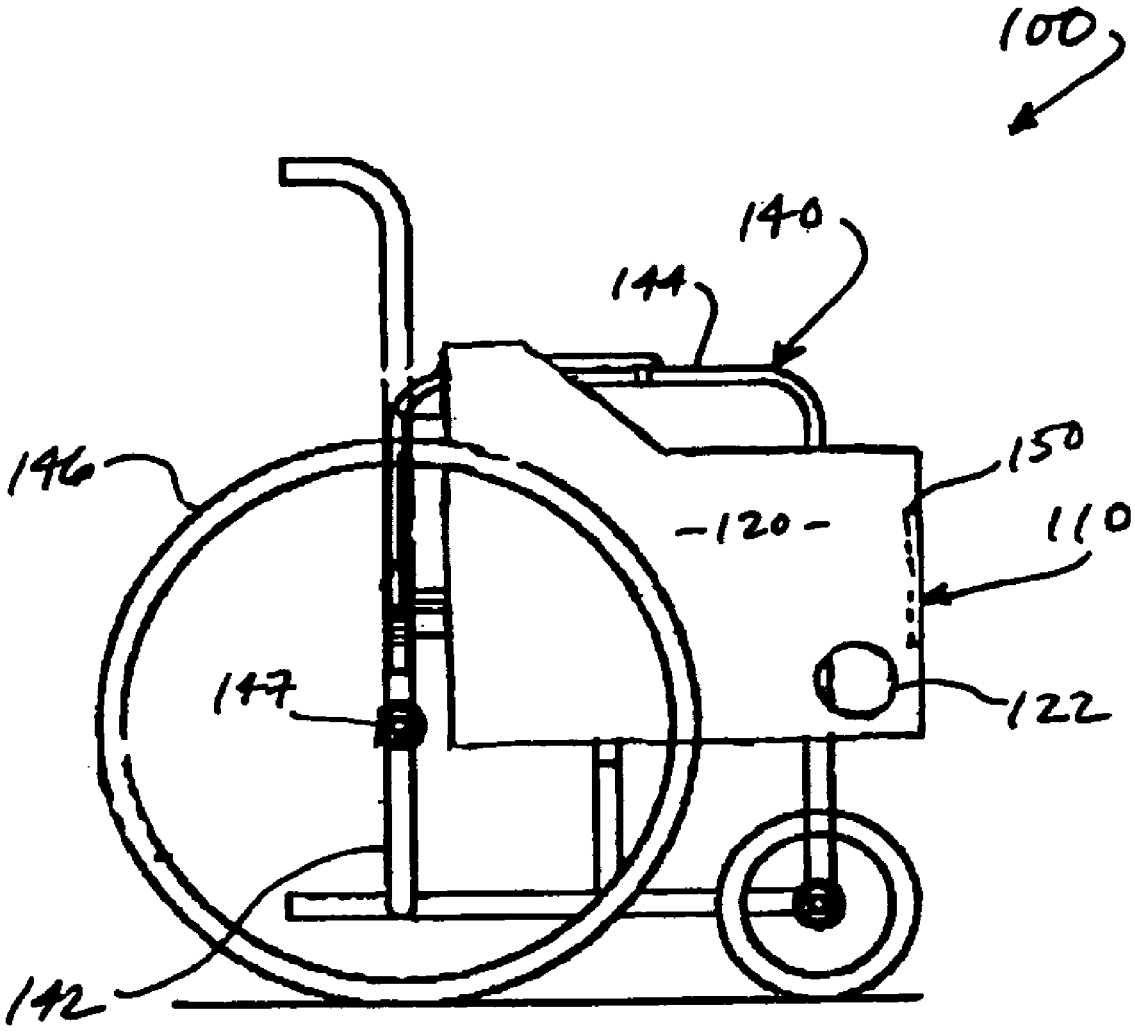
FIG. 10 is a side view of the exemplary wheelchair tray apparatus of FIG. 1, shown with the tray portion rotated into a second storage position.

In addition to the first storage position, the connecting portion 130 may allow the tray portion 110 to rotate into a second storage position, as shown in FIG. 10. When the connecting portion 130 is attached to the wheelchair 140, the tray portion 110 may be moved between the first storage position and the second storage position as desired. The first rotation of the tray portion 110 in the plane substantially parallel to the plane of rotation of the non-pivoting wheel 146 of the wheelchair 140, provided by the connecting portion, may also allow the tray portion 110 to be rotated from the intermediate position downward and toward the front of the wheelchair 140, e.g., clockwise in the FIGS., and into the second storage position as shown in FIG. 10.

As with the tray portion 110 in the first storage position, the second storage position may be achieved with the aid of gravity, for example, having the tray portion 110 come to rest against adjacent to an axle of the non-pivoting wheel 146, for example against the bumper 147. However, in the second storage position the tray portion 110 is conveniently placed in toward the front of the wheelchair 140. Thus, the second storage position of the tray portion 110 may allow unfettered access to handles 141 at the rear of the wheelchair 140 for another person to push or pull the wheelchair 140 from behind.

As shown in FIG. 10, the tray portion 110 may be positioned in the second storage position so as not to interfere with manual rotation of the non-pivoting wheel 146, e.g., allowing sufficient access to the user of the wheelchair 140. As shown in FIGS. 1 and 2, the tray portion 110 may be positioned in the first storage position between the frame 142 of the wheelchair 144 and the non-pivoting wheel 146, e.g., outside the handles 141. Thus, whether moving the wheelchair by manual rotation of the non-pivoting wheels 146 by the user or by pushing/pulling the handles 141 by another person, the first and second storage positions may be selected for movement over steeper inclines, i.e., downward inclines and upward inclines, respectively. Because of the first rotation provided by the connecting mechanism 130, gravity will urge the tray portion 110 against the bumper 147 according to the incline.

Alternatively or additionally, the first and second storage positions may be selected for movement over steeper inclines as an added safety measure, in case a latch or other securing mechanism holding the tray portion 110 in the respective storage position fails to hold the tray portion 110 sufficiently, for example, should the wheelchair 140 experience a jarring while moving over an incline.

As shown in FIG. 10, the tray portion 110 may be secured in the second storage position by any known or hereafter developed mechanism, such as the magnet strip 150 and another magnetic material as described above. For example, when the tray portion 110 includes the magnet strip 150, an appropriate part of the frame 142 may include a magnetic material such that the strip 150 and material are sufficiently attracted to each other to properly secure the tray portion 110 against the frame 142 in the second storage position. The same or a different approach may be used to secure the tray portion 110 in the first storage position.

Figure 11:
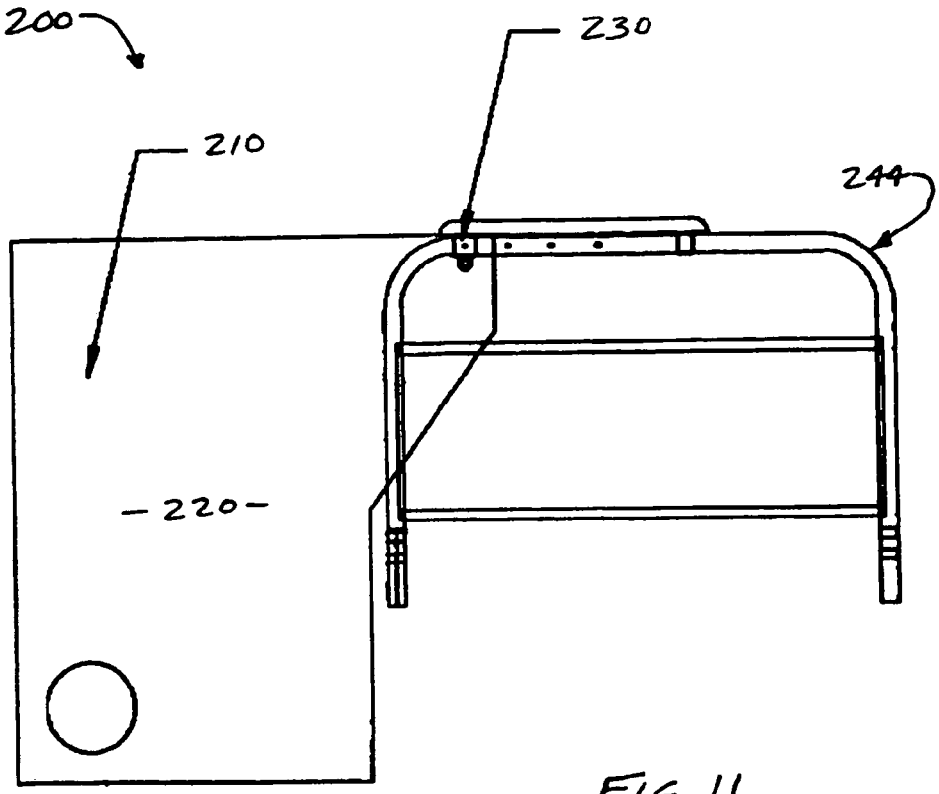
FIG. 11 is another exemplary wheelchair tray apparatus, including a replacement arm support member.
Figure 12:
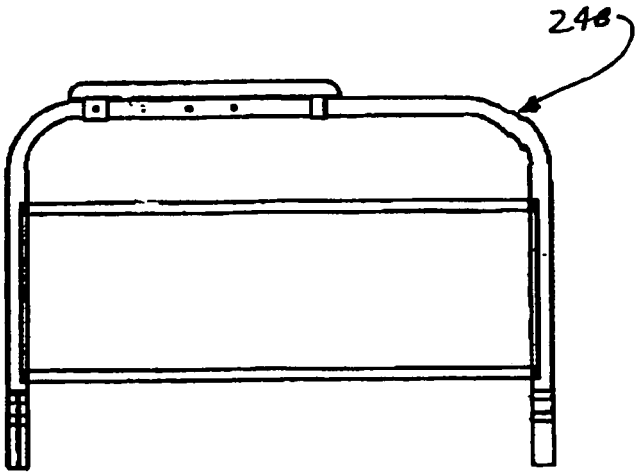
FIG. 12 is an exemplary replacement arm support member that may form a part of the exemplary wheelchair tray apparatus of FIG. 11.

FIGS. 11 and 12 show another exemplary wheelchair tray apparatus 200. The wheelchair apparatus 200 may include a tray portion 210 having a substantially planar working surface 220. The wheelchair tray apparatus 200 may further include a connecting portion 230. The connecting portion 230 may be of any known or hereafter developed configuration or design that is suitable for providing the rotational movements of the tray portion 210, as described herein, when the tray portion 210 is attached via the connecting portion 230.

As shown in FIG. 11, the wheelchair tray apparatus 200 may include a replacement arm support member 244. The replacement arm support member 244 may be of any known or hereafter developed configuration or design that is suitable for attaching to any existing or later developed wheelchair, for example, by removing an arm support member of the wheelchair and substituting the replacement arm support member 244 therefor.

The tray portion 210 and the connecting portion 230 may have features similar to the respective portions described for the exemplary wheelchair tray apparatus 100. In the wheelchair tray apparatus 200, the first rotation may be in a plane that is substantially parallel to a plane of the replacement arm support member 244. However, the first rotation may still be defined as being in a plane that is substantially parallel to a plane of a non-pivoting wheel of a wheelchair, when the replacement arm support member 244 is attached to the wheelchair.

As shown in FIG. 12, the wheelchair tray apparatus 200 may also include a second replacement arm support member 248. As with the replacement arm support-member 244, the second replacement arm support member 248 may be of any known or hereafter developed configuration or design that is suitable for attaching to any existing or later developed wheelchair, for example, by removing a second arm support member of the wheelchair and substituting the second replacement arm support member 248 therefor.

It should be understood that the replacement arm support members 244, 248 may have features similar to the respective members described for the exemplary wheelchair tray apparatus 100. Further, it should be understood that the function and operation of the wheelchair tray apparatus 200 may be similar to that described above for the exemplary wheelchair tray apparatus 100. The wheelchair tray apparatus 200 illustrates, however, that the wheelchair may not necessarily form part thereof.

Figure 13:
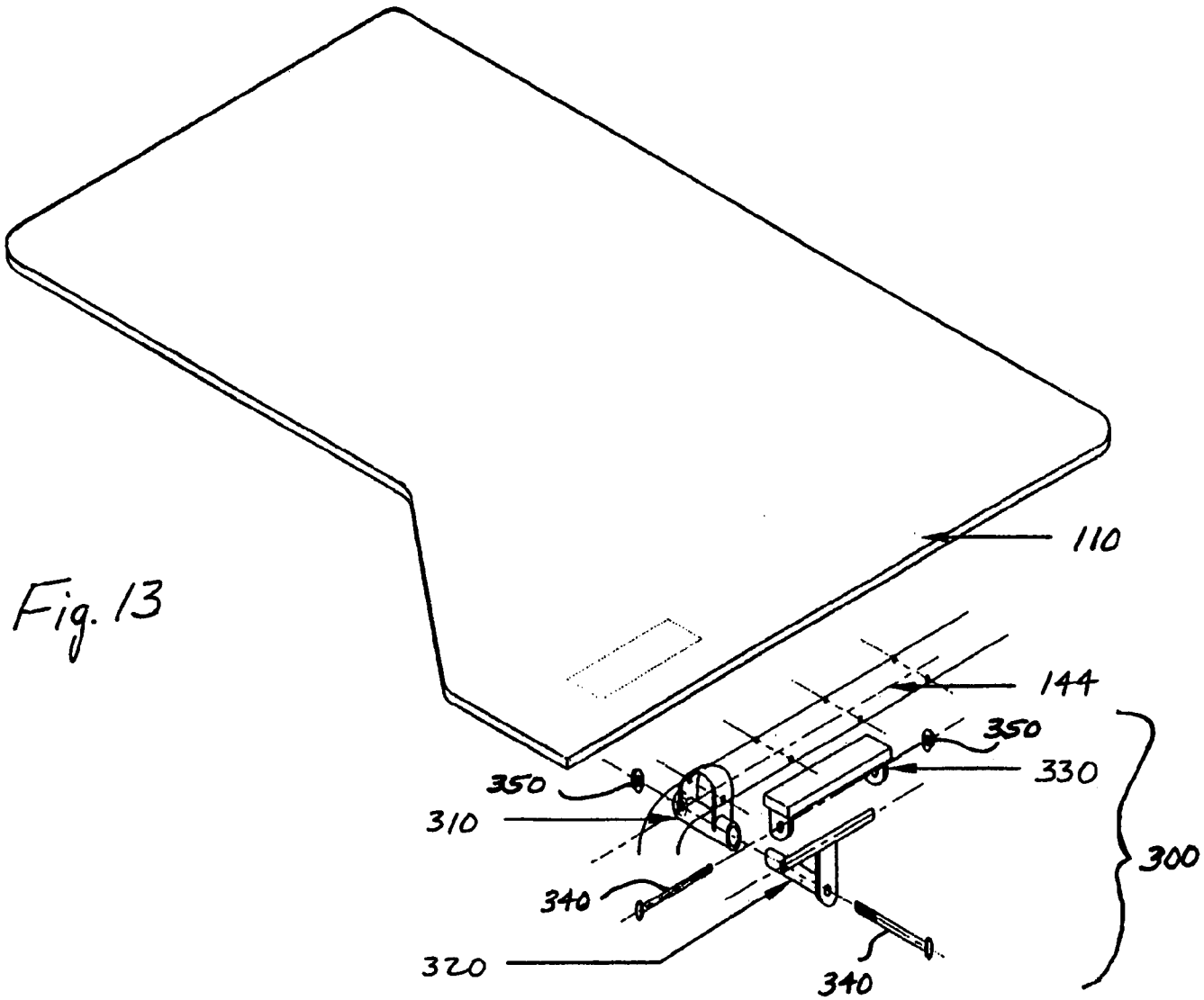
FIG. 13 is an exploded view of an exemplary connecting portion, a tray portion and a partial arm support member.

FIG. 13 is an exploded view of an exemplary connecting portion 300. As described above, the connecting portion 300 may be configured to facilitate movement of the tray portion 110 relative to an arm support member 144, which is shown only partially and transparently in FIG. 13. The connecting portion 300 may be partially or completely disassembled to allow attachment or detachment of the tray portion 110 and/or the connecting portion 300 from a wheelchair, as should be understood from the FIGS.

The connecting portion 300 may a tubular body 310, an L-shaped rod 320 and a bracket 330. The tubular body 310 may be connected to the arm support member 144 in an adjustable manner, for example, allowing the tubular body 310 to be positioned on the arm support member 144, as described below. One end of the L-shaped rod 320 may be rotatably inserted into the tubular body 310 while an opposite end of the L-shaped rod 320 may be pivotably connected to the bracket 330. The bracket 330 may be secured to the tray portion 110 in any suitable manner, as illustrated by dashed lines on the tray portion 110.

The L-shaped rod 320 may be rotatably connected to the tubular body 310 and pivotably connected to the bracket 330 in any suitable manner, for example, by bolts 340 and nuts 350 as shown. Any arrangement that maintains a secure connection that allows the desired rotational or pivotal movement between the L-shaped rod 320 and the tubular body 310 and the bracket 330 may be used.

Figure 16:
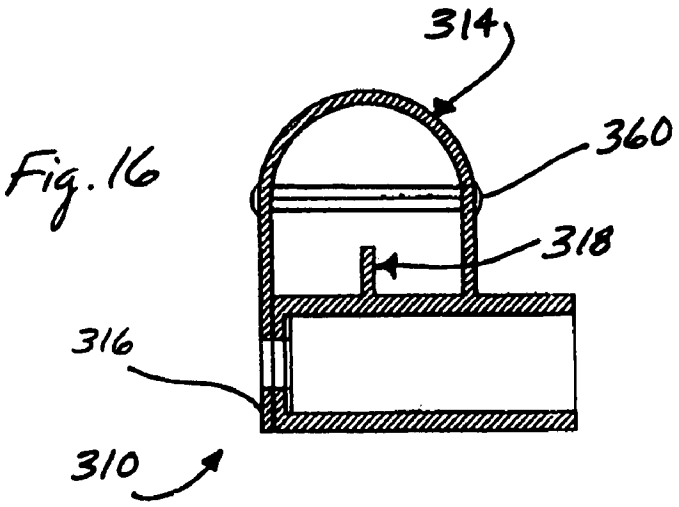
FIGS. 14–21 are various views of parts of the exemplary connecting portion of FIG. 13, shown in greater detail.
Figure 15:
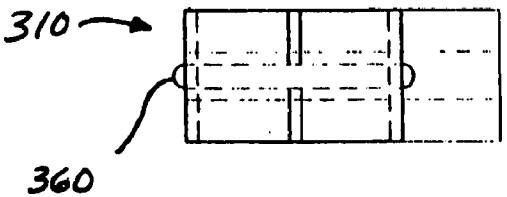
Figure 14:
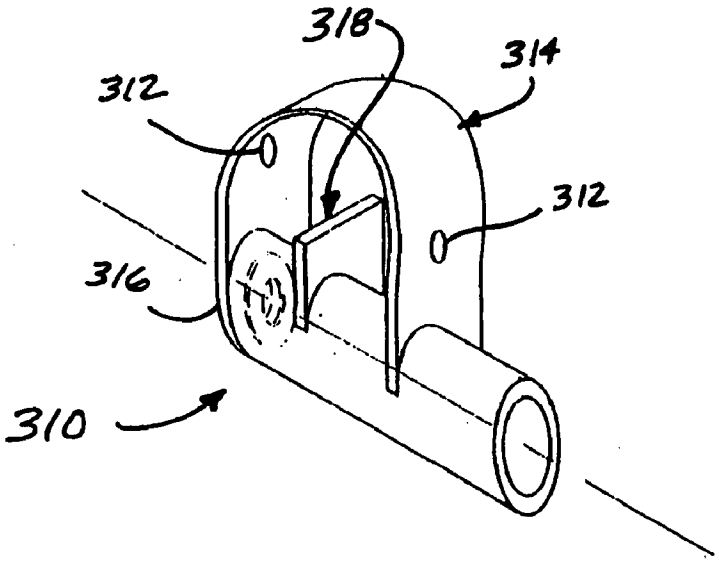
Figures 17, 18, 19:
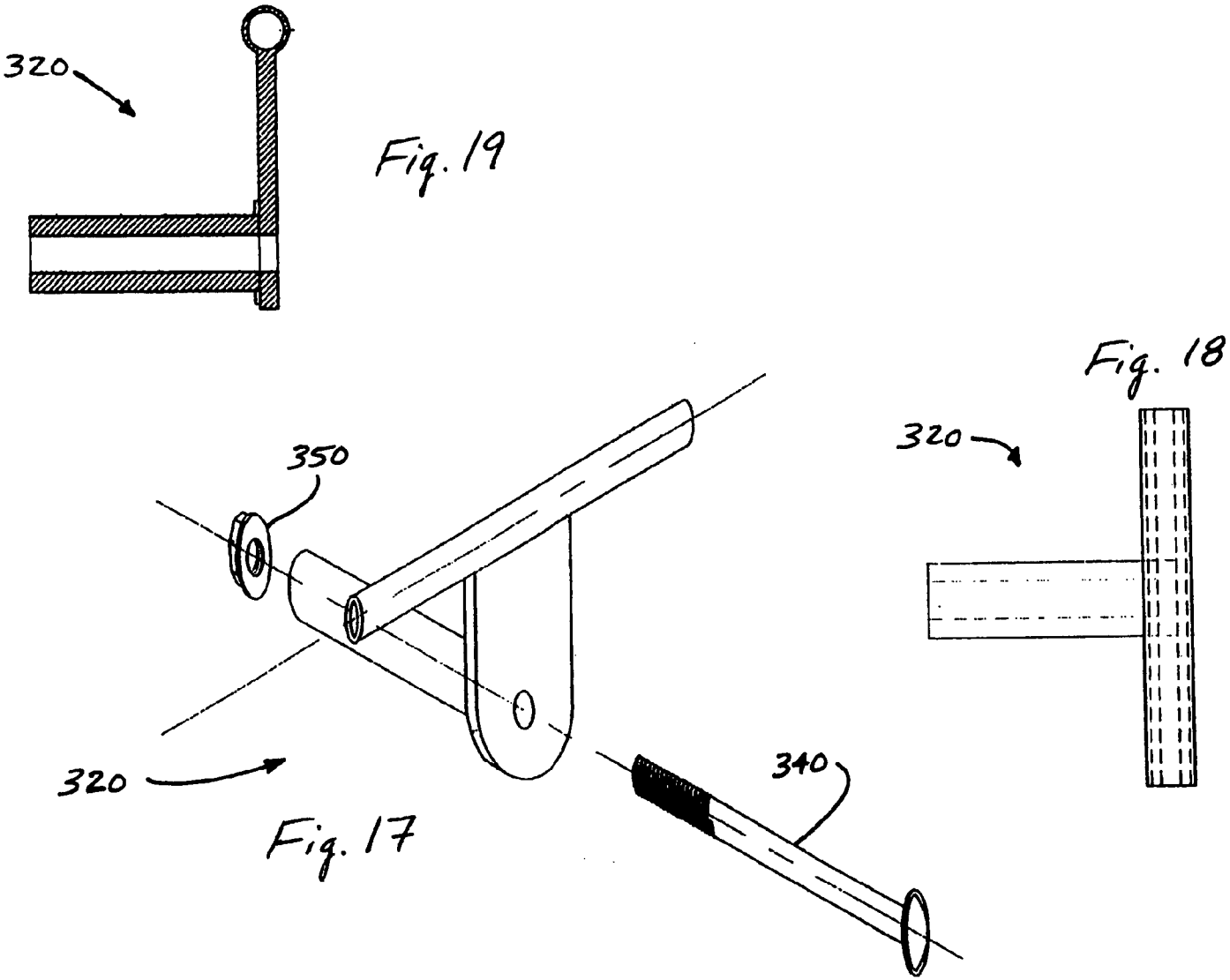
Figure 20:
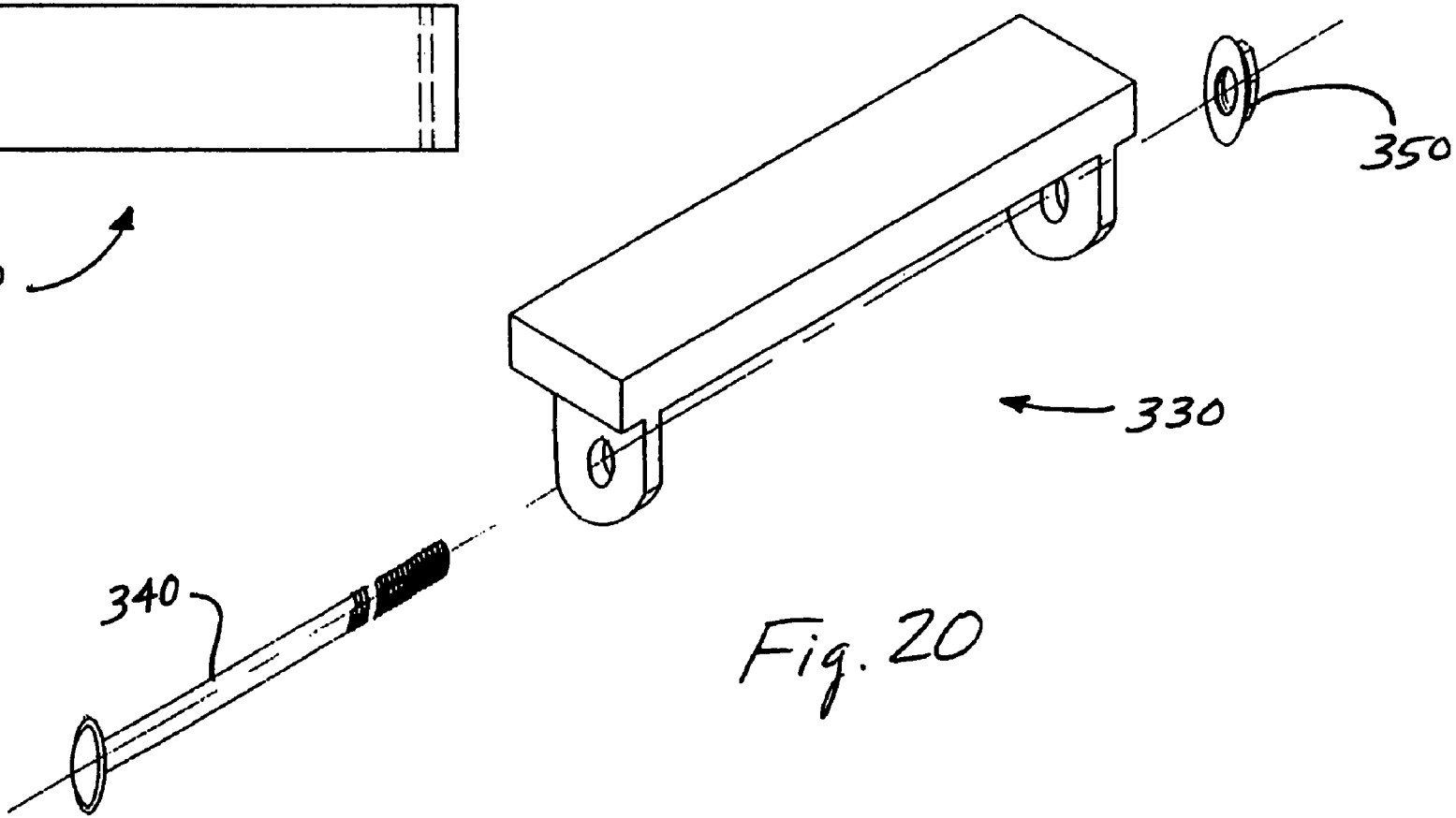
Figure 21:
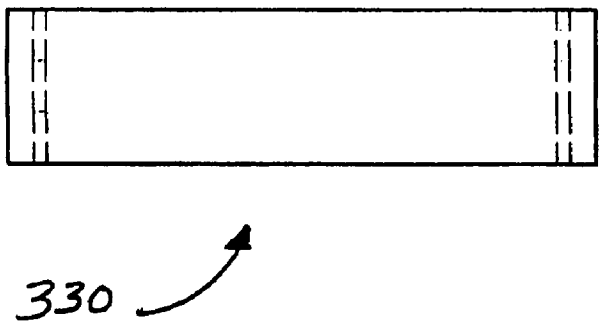

The tubular body 310 may be connected to the arm support member 144 by a pin 360 (shown in FIG. 16) arranged to cooperate with one or more holes 370 in the arm support member 144 and holes 312 in the tubular body 310. Alternatively, a detent and projection arrangement (not shown) may be provided between the tubular body 310 and the arm support member 144. Such arrangements may allow the tray portion 110 to be positioned a desired distance in front of a user of the wheelchair.

FIGS. 14–21 illustrate various exemplary details of the tubular body 310, the L-shaped rod 320 and the bracket 330. It should be understood that such details are exemplary only and non-limiting. For example, the tubular body 310 may include a relatively flexible portion 314 in which the holes 312 may be formed. The relatively flexible portion 314 may be configured to be passed around the arm support portion 144 with a free end 316 subsequently secured by the bolt 340 and nut 350 in the position illustrated in FIGS. 14–16. Additionally, the tubular body 310 may include a relatively rigid portion 318 that may engage the arm support portion 144 to prevent the tubular body 310 from rotating relative to the arm support portion 144 when the tubular body 310 is connected to the arm support portion 144.

Figure 22:
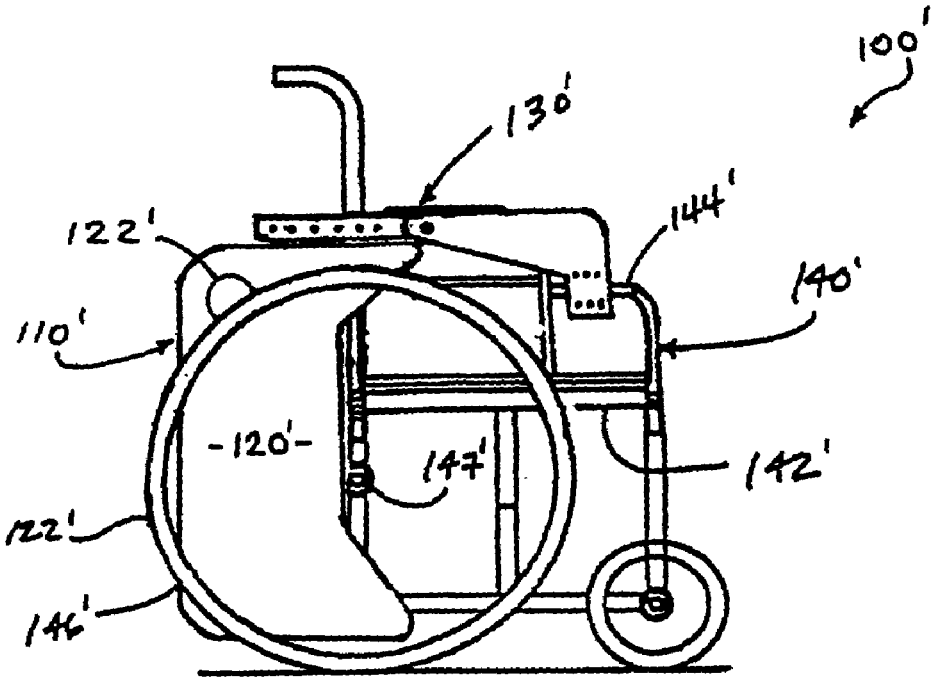
FIG. 22 is a side view of another exemplary wheelchair tray apparatus, shown with the tray portion in a storage position.

FIG. 22 illustrates an exemplary wheelchair tray apparatus 100'. As shown in this side view, the wheelchair apparatus 100' may include a tray portion 110' having a substantially planar working surface 120'.

The tray portion 110' and the working surface 120' may have any desired configuration. As discussed above, for example, the size and shape of the tray portion 110' may be designed for a particular use or for a person with a particular disability. A general multi-purpose design is shown having a recess or cutout 122' in the working surface 120'. The recess or cutout 122' is not limited to a single instance or a circular configuration as shown.

The wheelchair tray apparatus 100' may further include a connecting portion 130'. The connecting portion 130' may be of any known or hereafter developed configuration or design that is suitable for providing the rotational movements of the tray portion 110', as described herein, when the tray portion 110' is attached via the connecting portion 130'. In the configuration shown, the connecting portion includes two parts pivotally connected to each other, with one part connected to a portion 144' of a frame 142' of a wheelchair 140', and the other part pivotally connected to the tray portion 110', as described below.

As described above, the wheelchair tray apparatus 100' may or may not include the wheelchair 140'. For example, the wheelchair tray apparatus 100' may comprise the tray portion 110' and the connecting portion 130', with the connecting portion 130' designed to attach to a wheelchair of a particular or various design.

Figure 23:
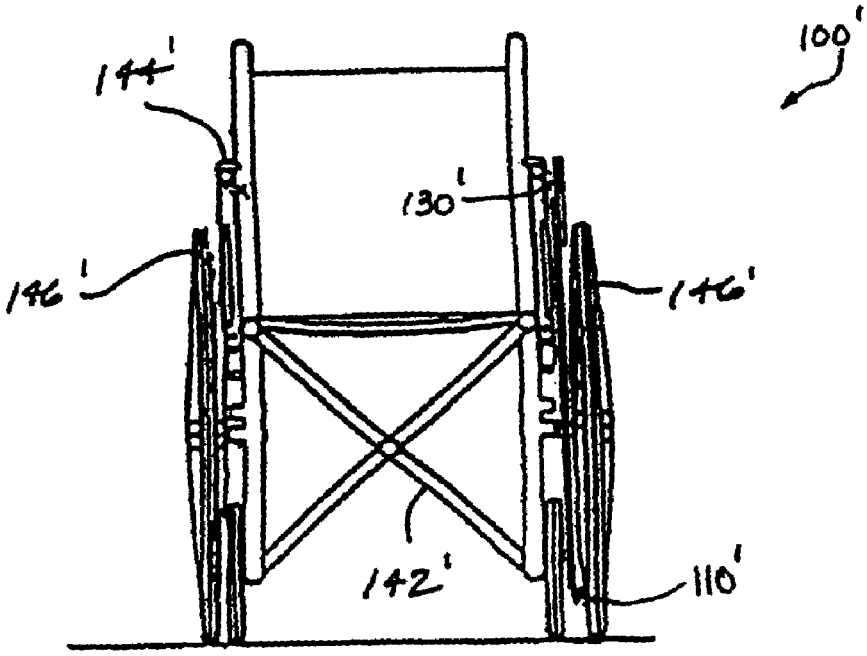
FIG. 23 is a rear view corresponding to FIG. 22.

As shown in FIG. 22, the wheelchair 140' may include the frame 142' or other support structure, for example, including at least one frame member, such as a support member 144'. The wheelchair 140' may also have a non-pivoting wheel 146' on each side. As illustrated in FIG. 23, for example, the frame 142' may be collapsible to allow the wheelchair 140' to be compacted for transportation and/or storage when not in use. The wheelchair tray apparatus 100' may allow for such a design of the frame 142' without substantially interfering with collapsing of the frame 142' or substantially impairing compactness. Other details of the wheelchair 140' are not provided since they are a matter of preference and design not critical to the disclosure.

The tray portion 110' may be attached, either permanently or detachably, to the wheelchair 140' via the connecting portion 130'. For example, the connecting portion 130' may attach to the frame 142'. In particular, connecting portion 130' may attach to the support member 144', as shown in FIG. 22.

When the connecting portion 130' is attached to the wheelchair 140', the tray portion 110' may be moved between a use position and a storage position. For example, the connecting portion 130' may provide a first rotation of the tray portion 110' in a plane substantially parallel to a plane of rotation of one of the non-pivoting wheels 146' of the wheelchair 140'. As shown in FIG. 22, the tray portion 110' may be conveniently placed in a storage position toward a rear of the wheelchair 140'. The storage position may be achieved with the aid of gravity, for example, having the tray portion 110' come to rest against adjacent to an axle of the non-pivoting wheel 146', for example, against a resilient cushion or bumper 147'.

In the storage position, the tray portion 110' may be disposed at least partly between the non-pivoting wheel 146' and the frame 142', as shown in FIGS. 22 and 23. The storage position may place substantially the entire tray portion 110' slightly below an upper surface of the support member 144', for example, to avoid contact with the user of the wheelchair 140' when the tray portion 110' is not in use. Further, the storage position may allow the user of the wheelchair 140' unfettered access to the non-pivoting wheel 146', for example, to allow the user to manually rotate the non-pivoting wheel 146' and/or operate a brake (not shown) to lock the non-pivoting wheel 146' against unwanted rotation.

Figure 24:
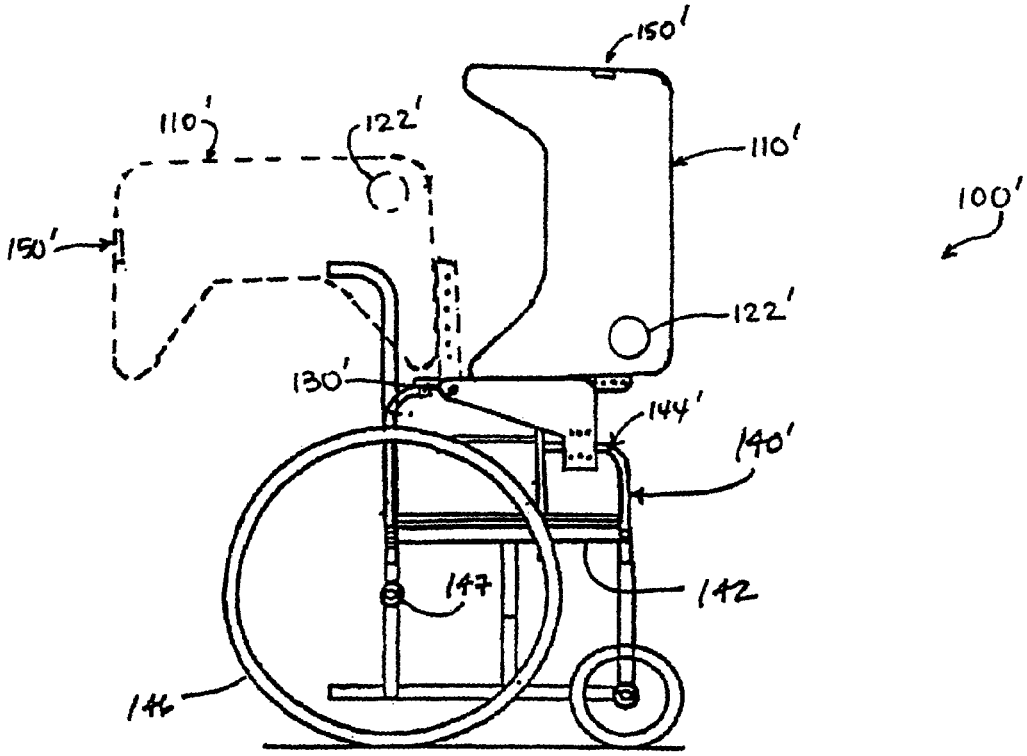
FIG. 24 is a side view of the exemplary wheelchair tray apparatus of FIG. 22, shown with the tray portion rotated from the storage position.
Figure 25:
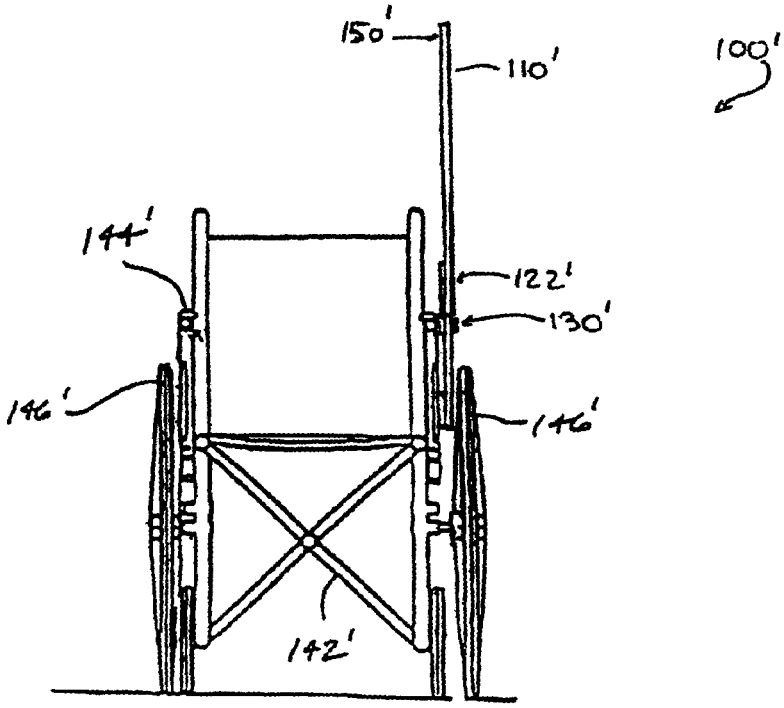
FIG. 25 is a rear view corresponding to FIG. 24.
Figure 26:
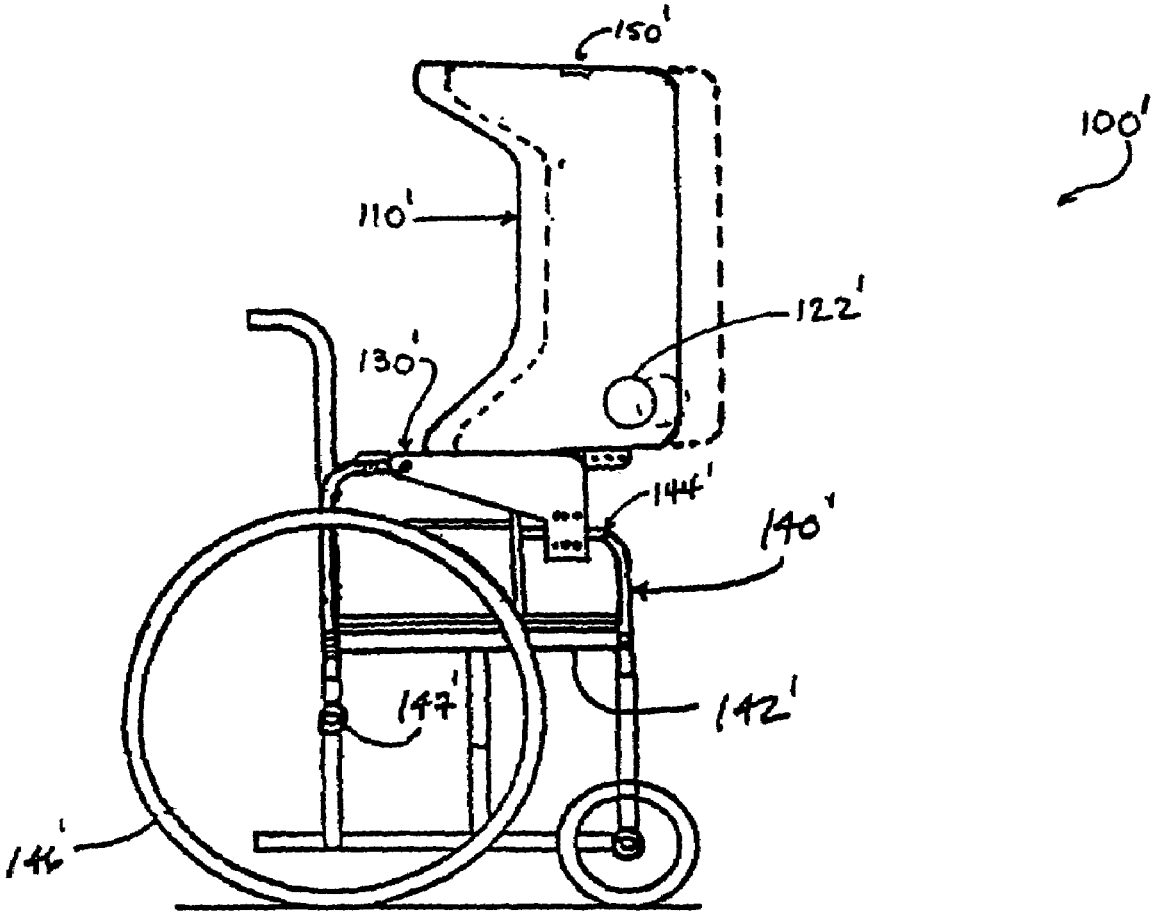
FIG. 26 is a side view of the exemplary wheelchair tray apparatus of FIG. 22, shown with the tray portion rotated into an intermediate position.

As illustrated in dashed-lines in FIG. 24, the first rotation in the plane substantially parallel to the plane of rotation of the non-pivoting wheel 146' provided by the connecting portion 130' may allow the tray portion 110' to be rotated from the storage position upward and toward a front of the wheelchair 140', e.g., clockwise in FIG. 24, and into a position as shown in FIGS. 24 and 25. As illustrated in dashed-lines in FIG. 26, the tray portion 110' may be include an optional movement of the tray portion 110' that allows the tray portion 110' to be translated in a forward-rearward direction relative to the wheelchair 140'. The connecting portion 130' may allow the tray portion 110' to be translated whether or not the tray portion 110' has been rotated in the plane substantially parallel to the plane of rotation of the non-pivoting wheel 146', and whether or not the tray portion 110' is in that plane of rotation. The translation of the tray portion 110' may place the tray portion 110' in a better position for use.

Figure 27:
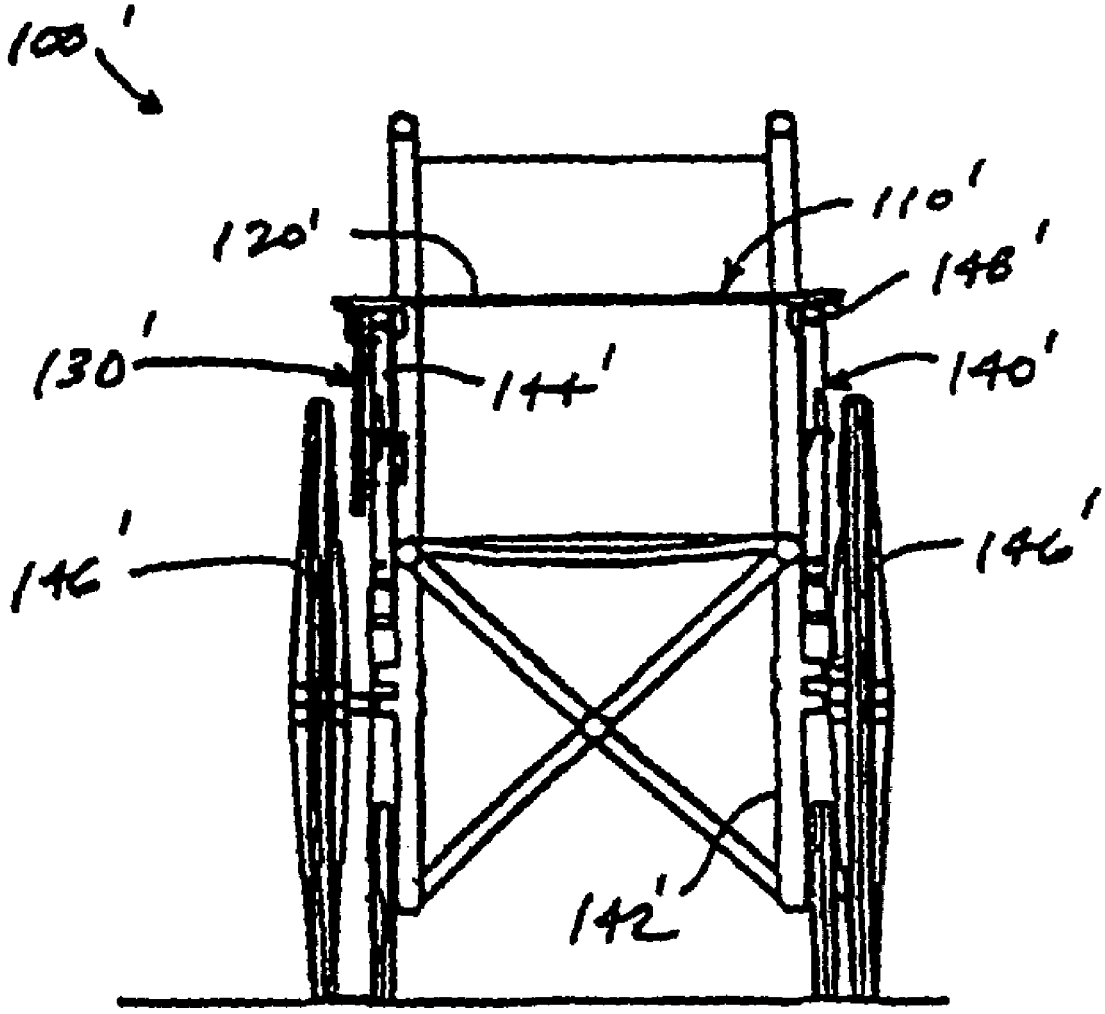
FIG. 27 is a front view of the exemplary wheelchair tray apparatus of FIG. 22, shown with the tray portion rotated into a use position.

The connecting portion 130' may also provide a second rotation of the tray portion 110' in a plane substantially perpendicular to the plane of rotation of the non-pivoting wheel 146' of the wheelchair 140'. As illustrated in FIG. 27, the second rotation in the plane substantially perpendicular to the plane of rotation of the non-pivoting wheel 146' provided by the connecting portion 130' may allow the tray portion 110' to be rotated from the intermediate position downward toward a lap of the user of the wheelchair 140', e.g., into the potion illustrated in FIG. 27, into a use position in front of the user.

As shown in FIG. 27, in the use position, the tray portion 110' may rest on the upper surface of the support member 144' and may extend toward a second support member 148' on an opposite side of the wheelchair 140'. Further, in the use position, the tray portion 110' may span the support members 144', 148', resting on the upper surface of each.

The tray portion 110' may be held in the use position by gravity. Alternatively or additionally, the tray portion 110' may be secured in the use position by any known or hereafter developed mechanism, as described above.

FIGS. 28 and 29 illustrate a tilting feature that may be provided by the connecting portion 130'. For example, the pivotal connection between the two parts of the connecting portion 130' may be provided with a mechanism that allows the two parts to be releasably fixed relative to each other, thereby releasably fixing the connecting portion 130' in a desired position. Although any known or hereafter developed mechanism may be used, an exemplary mechanism is described below with reference to FIG. 32. As illustrated in dashed lines in FIGS. 28 and 29, the tray portion 110' may thus be tilted at a non-zero angle relative to a seat of the wheelchair 140' when the tray portion 110' is in a use position. For example, such tilting may facilitate reading material placed on the working surface of the tray portion 110'.

Figure 30:
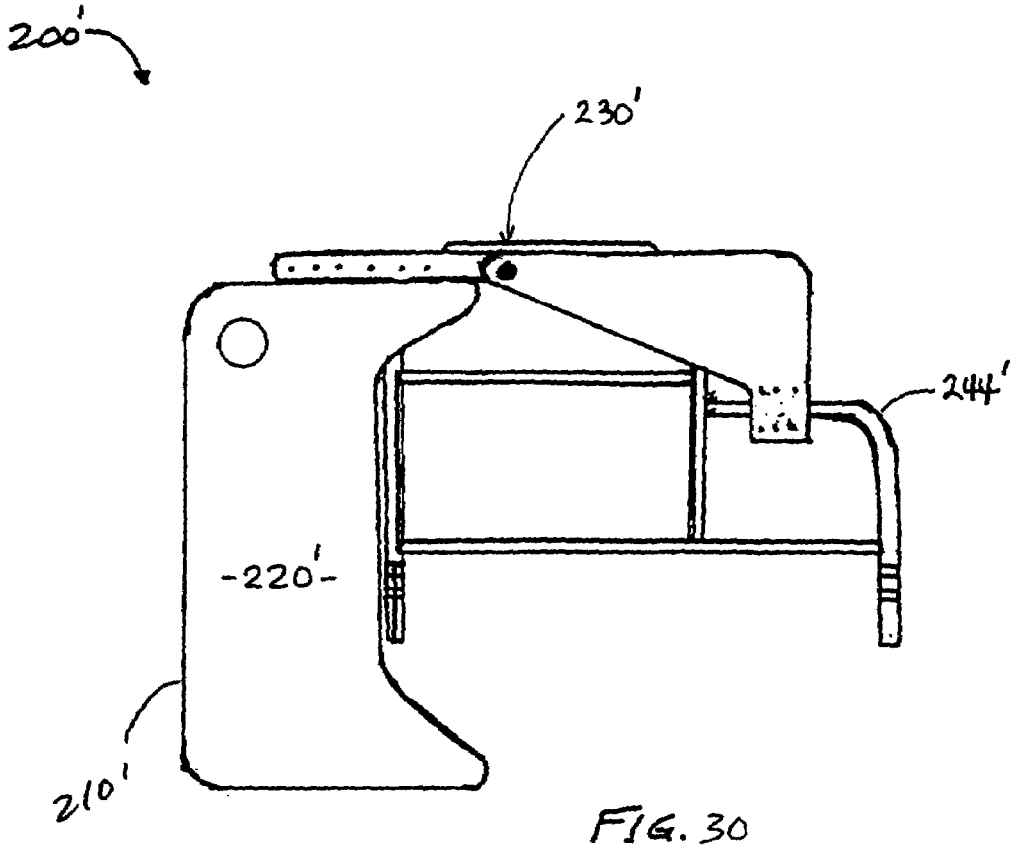
FIG. 30 is another exemplary wheelchair tray apparatus, including a replacement arm support member.
Figure 31:
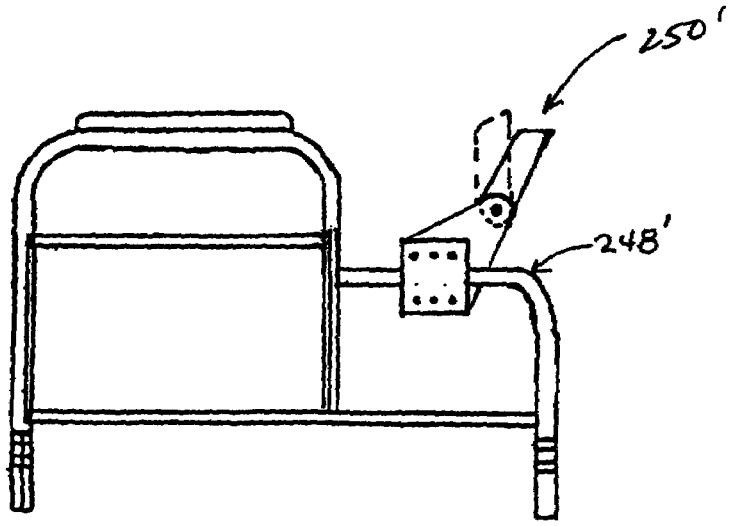
FIG. 31 is an exemplary replacement arm support member that may form a part of the exemplary wheelchair tray apparatus of FIG. 30.

FIGS. 30 and 31 show another exemplary wheelchair tray apparatus 200'. The wheelchair apparatus 200' may include a tray portion 210' having a substantially planar working surface 220'. The wheelchair tray apparatus 200' may further include a connecting portion 230'. The connecting portion 230' may be of any known or hereafter developed configuration or design that is suitable for providing the rotational movements of the tray portion 210', as described herein, when the tray portion 210' is attached via the connecting portion 230'.

As shown in FIG. 30, the wheelchair tray apparatus 200' may include a replacement arm support member 244'. The replacement arm support member 244' may be of any known or hereafter developed configuration or design that is suitable for attaching to any existing or later developed wheelchair, for example, by removing an arm support member of the wheelchair and substituting the replacement arm support member 244' therefor.

The tray portion 210' and the connecting portion 230' may have features similar to the respective portions described for the exemplary wheelchair tray apparatus 100'. In the wheelchair tray apparatus 200', the first rotation may be in a plane that is substantially parallel to a plane of the replacement arm support member 244'. However, the first rotation may still be defined as being in a plane that is substantially parallel to a plane of a non-pivoting wheel of a wheelchair, when the replacement arm support member 244' is attached to the wheelchair.

As shown in FIG. 31, the wheelchair tray apparatus 200' may also include a second replacement arm support member 248'. As with the replacement arm support member 244', the second replacement arm support member 248' may be of any known or hereafter developed configuration or design that is suitable for attaching to any existing or later developed wheelchair, for example, by removing a second arm support member of the wheelchair and substituting the second replacement arm support member 248' therefor.

As illustrated in FIG. 31, a support portion 250' may be connected to the second replacement arm support member 248'. The support portion 250', similar to the connecting portion 230', may be rotatable as illustrated in dashed lines. The support portion 250' may be releasably fixable in any desired position of rotation, for example, to extend upward to support the tray portion 210' in a use position, allowing the support portion 250' to be rotatably adjusted to account for any tilt of the tray portion 210', or to store by extending downward, for example, when not in use.

It should be understood that the replacement arm support members 244', 248' may have features similar to the respective members described for the exemplary wheelchair tray apparatus 100'. Further, it should be understood that the function and operation of the wheelchair tray apparatus 200' may be similar to that described above for the exemplary wheelchair tray apparatus 100'. The wheelchair tray apparatus 200' illustrates, however, that the wheelchair may not necessarily form part thereof.

Figure 32:
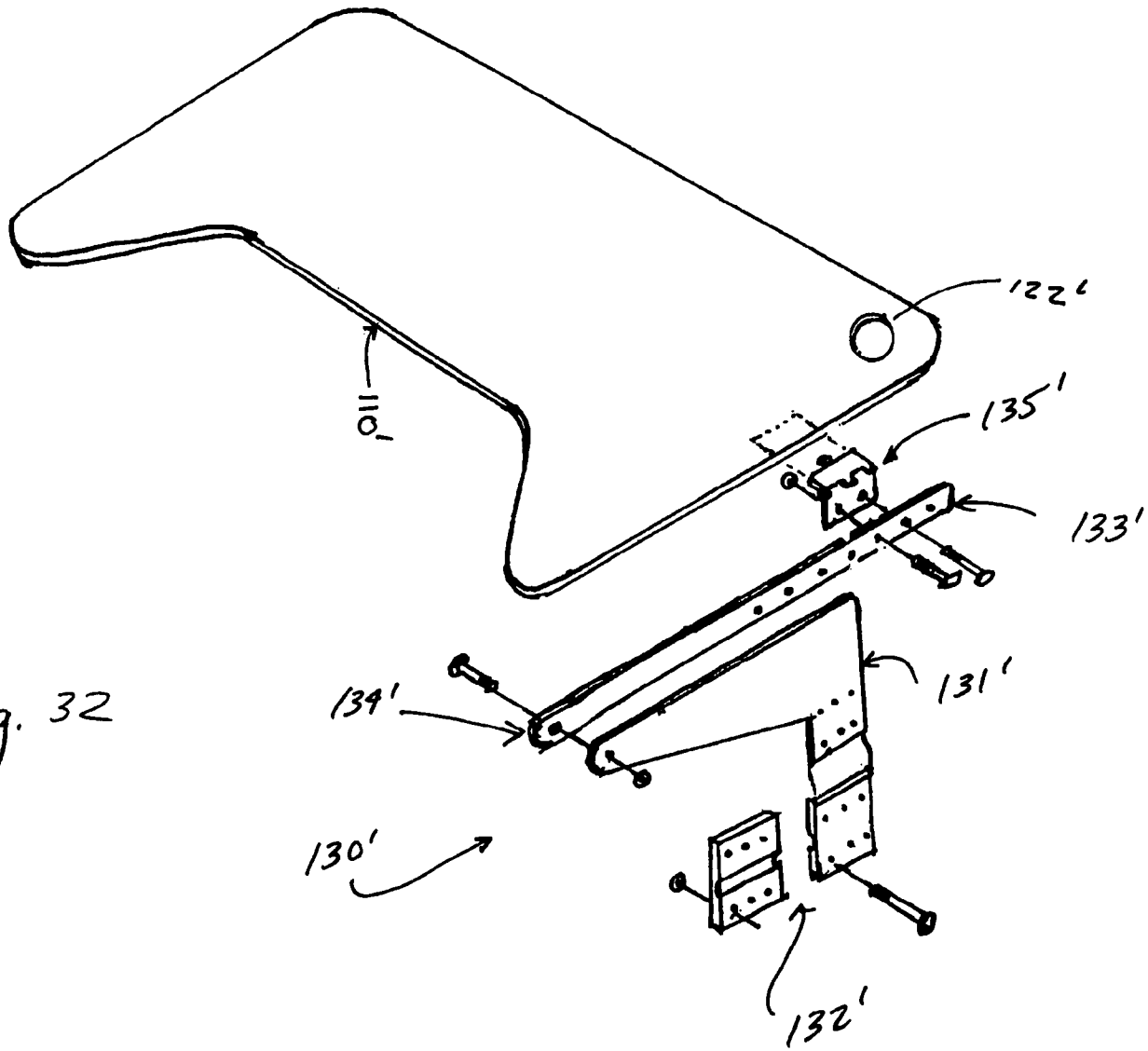
FIG. 32 is an exploded view of an exemplary connecting portion, a tray portion and a partial arm support member.

FIG. 32 is an exploded view of an exemplary connecting portion 130'. As described above, the connecting portion 130' may be configured to facilitate movement of the tray portion 110' relative to a support member. The connecting portion 130' may be partially or completely disassembled to allow attachment or detachment of the tray portion 110' and/or the connecting portion 130' from a wheelchair, as should be understood from FIG. 32.

The connecting portion 130' may include a first part 131' that is configured to be attached to a frame of a wheelchair, for example, by a bracket 132'. Although bolts are illustrated for connecting the bracket 132' to the frame, it should be understood that any suitable connection to the frame may be made, such as clamping without bolts.

The connecting portion 130' may include a second part 133' that is configured to be attached to the tray portion 110', for example, by a hinged bracket 135'. Although bolts are illustrated for connecting the hinged bracket 135' to the tray portion 110', it should be understood that any suitable connection to the tray portion 110' may be made, such as one that allows the tray portion 110' to slide along the second part 133' and releasably engage detents or the like.

The first and second parts 131', 133' may be pivotally connected by a connector 134'. Although a bolt is illustrated as the connector 134', it should be understood that any suitable connector may be employed, especially one that allows the first and second parts 131', 133' to be releasably fixed relative to one another, for example, by tightening the connector 134' to frictionally hold the first and second parts 131', 133' together. For example, the connector 134' may include a manual knob (not shown) for tightening.

Figure 33:
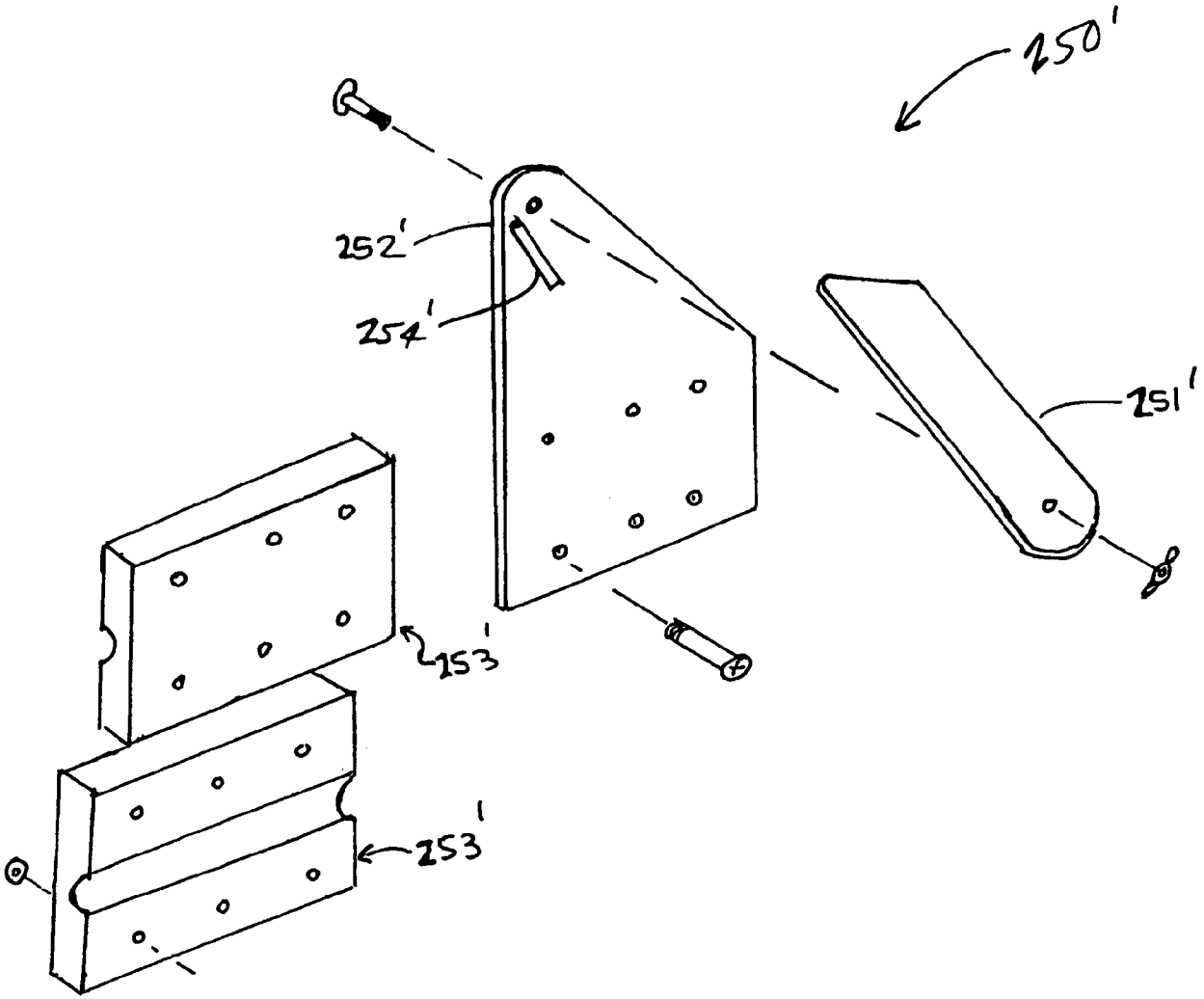
FIG. 33 is an exploded view of an exemplary support portion.

FIG. 33 is an exploded view of an exemplary support portion 250'. As described above, the support portion 250' may be configured to facilitate support of the tray portion 110' in a use position. The support portion 250' may be partially or completely disassembled to allow attachment or detachment of the support portion 250' from a wheelchair, as should be understood from FIG. 33.

The support portion 250' may include a first part 252' that is configured to be attached to a frame of a wheelchair, for example, by a bracket 253'. Although bolts are illustrated for connecting the bracket 253' to the frame, it should be understood that any suitable connection to the frame may be made, such as clamping without bolts.

The support portion 250' may include a second part 251' that is configured to be rotatably connected with the first part 252'. Although a bolt is illustrated for pivotally connecting the first and second parts 252', 251', it should be understood that any suitable connection between the two parts may be made that allows the second part 251' to be rotated and releasably fixed relative to the first part 252', similarly to the above description.

The first part 252' may include a stop 254' that is configured to limit rotation of the second part 251'. As described above, the limit may place the second part 251' of the support portion 250' in a position in which it will support the tray portion (not shown) in a substantially flat or horizontal use position, while other positions of the second part 251' may accommodate a tilt of the tray portion in the use position.

While various details have been described above, various alternatives, modifications, variations, improvements, and/or substantial equivalents, whether known or that are or may be presently unforeseen, may become apparent upon reviewing the foregoing disclosure. Accordingly, the details and implementations set forth above are intended to be illustrative, not limiting.

What is claimed is:

1. A wheelchair tray apparatus, comprising:

a tray portion providing at least one substantially planar working surface; and a connecting portion attached to the tray portion;

the connecting portion being configured to attach to a first portion of a frame of a wheelchair;

the connecting portion providing a first rotation of the tray portion in a plane substantially parallel to a plane of rotation of a non-pivoting wheel of the wheelchair when the connecting portion is attached to the wheelchair;

the connecting portion providing a second rotation of the tray portion in a plane substantially perpendicular to the plane of rotation of the non-pivoting wheel of the wheelchair when the connecting portion is attached to the wheelchair; and the connecting portion being releasably fixable against the first rotation such that the at least one substantially planar working surface is disposed at a non-zero angle relative to a plane including a seat of the wheelchair when the connecting portion is attached to the wheelchair and the tray portion is in a use position.

2. The wheelchair tray apparatus of claim 1, further comprising a securing mechanism mounted on a part of the tray portion other than the working surface, the securing mechanism being configured to cooperate with a part of a wheelchair when the connecting portion is attached to the wheelchair and the tray portion is in a storage position.

3. A wheelchair tray apparatus, comprising:

a tray portion providing at least one substantially planar working surface;

a connecting portion attached to the tray portion;

the connecting portion being configured to attach to a first portion of a frame of a wheelchair;

the connecting portion providing a first rotation of the tray portion in a plane substantially parallel to a plane of rotation of a non-pivoting wheel of the wheelchair when the connecting portion is attached to the wheelchair;

the connecting portion providing a second rotation of the tray portion in a plane substantially perpendicular to the plane of rotation of the non-pivoting wheel of the wheelchair when the connecting portion is attached to the wheelchair;

the connecting portion being releasably fixable against the first rotation; and a support member that is configured to attach to a second portion of a frame of a wheelchair, the support member being rotatable in a plane substantially parallel to the plane of rotation of the non-pivoting wheel of the wheelchair when the support portion is attached to the wheelchair, the support member being releasably fixable against rotation.

4. The wheelchair tray apparatus of claim 3, wherein the connecting portion is releasably fixable such that the at least one substantially planar working surface is disposed at a non-zero angle relative to a plane including a seat of the wheelchair when the connecting portion is attached to the wheelchair and the tray portion is in a use position, and the support member is releasably fixable to support the tray portion at the non-zero angle.

5. The wheelchair tray apparatus of claim 3, further comprising a stop that limits rotation of the support member to a predetermined position.

6. The wheelchair tray apparatus of claim 5, wherein the support member in the predetermined position supports the tray portion such that the at least one substantially planar working surface is disposed substantially parallel to a plane including a seat of the wheelchair when the connecting portion and the support portion are attached to the wheelchair and the tray portion is in a use position.

7. The wheelchair tray apparatus of claim 3, further comprising a securing mechanism mounted on a part of the tray portion other than the working surface, the securing mechanism being configured to cooperate with the support member when the connecting portion and the support portion are attached to the wheelchair and the tray portion is in a use position.

8. The wheelchair tray apparatus of claim 7, wherein the securing mechanism is magnetic.

9. The wheelchair tray apparatus of claim 7, wherein the securing mechanism is non-magnetic.

10. The wheelchair tray apparatus of claim 3, further comprising a securing mechanism mounted on a part of the tray portion other than the working surface, the securing mechanism being configured to cooperate with a part of a wheelchair when the connecting portion is attached to the wheelchair and the tray portion is in a storage position.

11. A wheelchair, comprising:

a wheelchair frame including at least one frame member disposed adjacent to a non-pivoting wheel rotatably mounted on an axle; and a wheelchair tray apparatus, including a tray portion providing at least one substantially planar working surface; and a connecting portion attached to the tray portion;

the connecting portion being configured to attach to a first portion of a frame of a wheelchair;

the connecting portion providing a first rotation of the tray portion in a plane substantially parallel to a plane of rotation of a non-pivoting wheel of the wheelchair when the connecting portion is attached to the wheelchair;

the connecting portion providing a second rotation of the tray portion in a plane substantially perpendicular to the plane of rotation of the non-pivoting wheel of the wheelchair when the connecting portion is attached to the wheelchair;

the connecting portion being releasably fixable against the first rotation; and the connecting portion being attached to the frame member, wherein the plane of the first rotation is located between the non-pivoting wheel and the frame.

12. The wheelchair tray apparatus of claim 11, wherein the first rotation of the tray portion includes a storage position of the tray portion between the non-pivoting wheel and the frame.

13. The wheelchair tray apparatus of claim 12, wherein the tray portion in the storage position is substantially rearward of the axle of the non-pivoting wheel.

14. The wheelchair tray apparatus of claim 11, further comprising a securing mechanism mounted on a part of the tray portion other than the working surface, the securing mechanism being configured to cooperate with a part of a wheelchair when the connecting portion is attached to the wheelchair and the tray portion is in a storage position.

15. A method of operating a wheelchair tray apparatus, comprising a tray portion that provides at least one substantially planar working surface and a connecting portion attached to the tray portion, the method comprising:

attaching the connecting portion to a first portion of a frame of a wheelchair;

providing a first rotation of the tray portion in a plane substantially parallel to a plane of rotation of a non-pivoting wheel of the wheelchair and between the portion of the frame of the wheelchair and the non-pivoting wheel of the wheelchair via the connecting portion;

providing a second rotation of the tray portion in a plane substantially perpendicular to the plane of rotation of the non-pivoting wheel of the wheelchair; and selectively rotating the tray portion via the first rotation and the second rotation.

16. The method of claim 15, wherein selectively rotating the tray portion comprises:

rotating the tray portion via the first rotation into a storage position in which substantially all of the tray portion is rearward of an axle of the non-pivoting wheel.

17. The method of claim 15, wherein selectively rotating the tray portion compnses:

rotating the tray portion via the first rotation into a first position; and rotating the tray portion via the second rotation into a use position while the tray portion is in the first position.

18. The method of claim 17, further comprising supporting the tray portion in the use position while the tray portion is in the first position using a support portion other than the connecting portion.

19. The method of claim 17, wherein rotating the tray portion via the first rotation into the first position is such that the at least one substantially planar working surface is disposed at a non-zero angle relative to a plane including a seat of the wheelchair.

20. The method of claim 19, further comprising releasably fixing the tray portion in the first position.

* * * * *